US005320595A

United States Patent [19]

Hirata et al.

[11] Patent Number: 5,320,595

[45] Date of Patent: Jun. 14, 1994

[54] PUNCH PRESS AND A TOOL MAGAZINE FOR THE PRESS

[75] Inventors: Tadashi Hirata; Morikatsu Matsuda, both of Kanagawa, Japan

[73] Assignee: Amada Company, Limited, Kanagawa, Japan

[21] Appl. No.: 746,982

[22] Filed: Aug. 19, 1991

[30] Foreign Application Priority Data

| | | | |
|---|---|---|---|
| Aug. 22, 1990 | [JP] | Japan | 2-218940 |
| Jan. 30, 1991 | [JP] | Japan | 3-010029 |
| Jul. 4, 1991 | [JP] | Japan | 3-051758[U] |
| Jul. 4, 1991 | [JP] | Japan | 3-051764[U] |

[51] Int. Cl.[5] ..... B23Q 3/155

[52] U.S. Cl. ..... 483/29; 72/446; 83/563; 483/64

[58] Field of Search ..... 29/568; 83/552, 563; 72/442, 446; 483/28, 29, 64

[56] References Cited

U.S. PATENT DOCUMENTS

| | | | |
|---|---|---|---|
| 4,587,716 | 5/1986 | Bytow | 83/563 |
| 4,719,691 | 1/1988 | Klingel | 29/568 |
| 4,878,288 | 11/1989 | Messner | 29/568 |
| 5,070,593 | 12/1991 | Sahari et al. | 72/446 |

FOREIGN PATENT DOCUMENTS

| | | | |
|---|---|---|---|
| 0128487 | 12/1984 | European Pat. Off. . | |
| 0129866 | 1/1985 | European Pat. Off. . | |
| 0180823 | 5/1986 | European Pat. Off. . | |
| 0241933 | 10/1987 | European Pat. Off. . | |
| 0377865 | 7/1990 | European Pat. Off. . | |
| 3507220 | 3/1986 | Fed. Rep. of Germany . | |
| 3907687 | 9/1989 | Fed. Rep. of Germany . | |
| 0157422 | 12/1980 | Japan | 29/568 |
| 61-115630 | 6/1986 | Japan . | |
| 62-127321 | 8/1987 | Japan . | |
| 64-135 | 1/1989 | Japan . | |

OTHER PUBLICATIONS

European Search Report and Annex.

*Primary Examiner*—Z. R. Bilinsky

*Attorney, Agent, or Firm*—Sandler, Greenblum & Bernstein

[57] ABSTRACT

A punch press provided with a tool magazine in which a plurality of tool mounting gondolas are supported movably in a vertical loop by and between two endless chains arranged vertically around sprocket wheels. Each gondola is supported at its supporting points which differ from each other at least in height, whereby the gondola is moved around in the loop without overturn when the sprocket wheels are rotated by a motor. Each of the gondolas stays at a manually tool changing location of the magazine where a table is provided for changing a number of tool assemblies in the magazine. The table has at least one guide which is positioned at two different heights, and along the guide tool assemblies or an upper and a lower die holders are drawn out of the gondola horizontally and placed in desired positions for replacement.

6 Claims, 22 Drawing Sheets

PUNCH PRESS AND A TOOL MAGAZINE FOR THE PRESS

BACKGROUND OF THE INVENTION

1. Field of the Invention

This invention relates to a punch press, in particular to a punch press provided with an improved tool magazine.

2. Description of the Prior Art

A conventional punch press has a tool magazine of horizontal type or vertical type for storing tool assemblies to be used. The tool assemblies are taken out for use of the magazine at its automatically tool changing location and then carried and attached to a tool attaching section of the punch press by an automatic tool changer which also takes out tool assemblies of the tool attaching section of the punch press and carries them to the tool magazine.

Punch presses provided with a tool magazine of horizontal type are, for example, described in Japanese patent (U) 62-127321 and West Germany Patent (A1) 3507220. A press described in the above Japanese Patent has a tool magazine within a frame of the press, and therefore the number of tool assemblies stored in the magazine is limited. A press described in the above West German Patent has a tool magazine outside a frame of the press and therefore occupies a large area for the magazine.

A tool magazine of vertical type is, for example, described in Japanese patent (A) 61-115630. In this tool magazine, tool assemblies will be upside down when the magazine is operated to select the tool assemblies. This troubles the operator for changing tool assemblies manually with ease.

When a number of tool assemblies in the magazine are replaced with other tool assemblies at the manually tool changing location opposite the automatically tool changing location of the magazine, it is carried out manually. Therefore, the operator is sometimes injured when changing or carrying the tool assemblies since the weight of a punching tool assemblies or an upper die holder is about 25 Kg (245N, 55 pounds). Japanese Patent (B2) 64-135 discloses a device whereby the operator can take out tool assemblies safely of a tool magazine. For this device, however, a pair of tool assemblies, that is, an upper and a lower die holders taken out are superimposed. This makes it difficult for the operator to handle the tool assemblies easily and therefore handle them safely.

SUMMARY OF THE INVENTION

It is therefore a first object of the present invention to provide a punch press including within the press a tool magazine in which a number of tool assemblies are stored It is a second object of the present invention to provide an improved tool magazine for a punch press which enables the operator to take out tool assemblies of and push them into the magazine at its manually tool changing location, manually with ease for his safety.

The punch press of the present invention includes at least a tool carrying section for carrying a pair of tool assemblies attachably and detachably, a tool magazine adjacent to the tool carrying section for storing a plurality of tool assemblies, and a tool changer which moves between the tool carrying and the tool magazine for taking out tool assemblies of the magazine and then attaching the tool assemblies to the tool carrying section, wherein the tool magazine supports a plurality of gondolas each carrying at least a pair of tool assemblies, at supporting points on the gondola, the supporting points being different from each other at least in height.

In particular, on the tool magazine mounted are two groups of sprocket wheels which are vertically arranged beside the gondolas, two endless chain respectively attached to around each group of sprocket wheels, and a driving device such as a motor for rotating the groups of sprocket wheels. The gondolas are spaced and supported pivotally by and between the two chains and moved vertically in the loop while kept in the upright position by means of the driving device. A group of sprocket wheels of the above are shifted the same height from another group as the height difference of the supporting points.

A tool magazine of the present invention for a punch press supports a plurality of tool mounting gondolas movably vertically in the magazine and has a table provided with at least a guide which is positioned at two different heights, wherein an upper and a lower die holders can be drawn out of the gondola respectively along the guide horizontally one by one at the two different heights.

The table of the tool magazine is slidable transversely to stop in front of each pair of tool assemblies in the gondola which stays at the manually tool changing location.

The table of the tool magazine includes, for example, at least two guides arranged at different heights, along which the upper and lower die holders are respectively guided and drawn out of the gondola horizontally and placed in desired positions.

In the tool magazine, the upper and lower die holders are drawn out of the gondola along the guide horizontally in same parallel directions and placed in different positions on the table which are not superimposed.

The table is preferably a fold-away table.

An example of the tool magazine includes a device for shifting the table with the guide in an upper and lower positions, wherein the upper die holder is moved horizontally along the guide of the table which is in the upper position while the lower die holder is moved along the guide of the table which is in the lower position.

The table of the tool magazine includes, for example, at least a device for sliding along the guide and engaging with the tool assemblies for drawing the tool assemblies out horizontally to desired positions.

According to the punch press of the present invention, a great number of tool assemblies are stored in the tool magazine which occupies only a small area. Furthermore, the tool assemblies are kept in position without overturn in the gondolas when the gondolas are moved in the vertical loop. Therefore, the automatic tool changer can easily take out tool assemblies of the tool magazine at its automatically tool changing location, and the operator can easily change tool assemblies in the tool magazine at its manually tool changing location.

According to the tool magazine of the present invention, the operator can easily and safely change tool assemblies in the tool magazine by using a table attached to the magazine. The table can be fold up when not used.

DESCRIPTION OF THE PREFERRED EMBODIMENTS

Now, the present invention is described in detail with reference to accompanying drawings.

Figure 1:
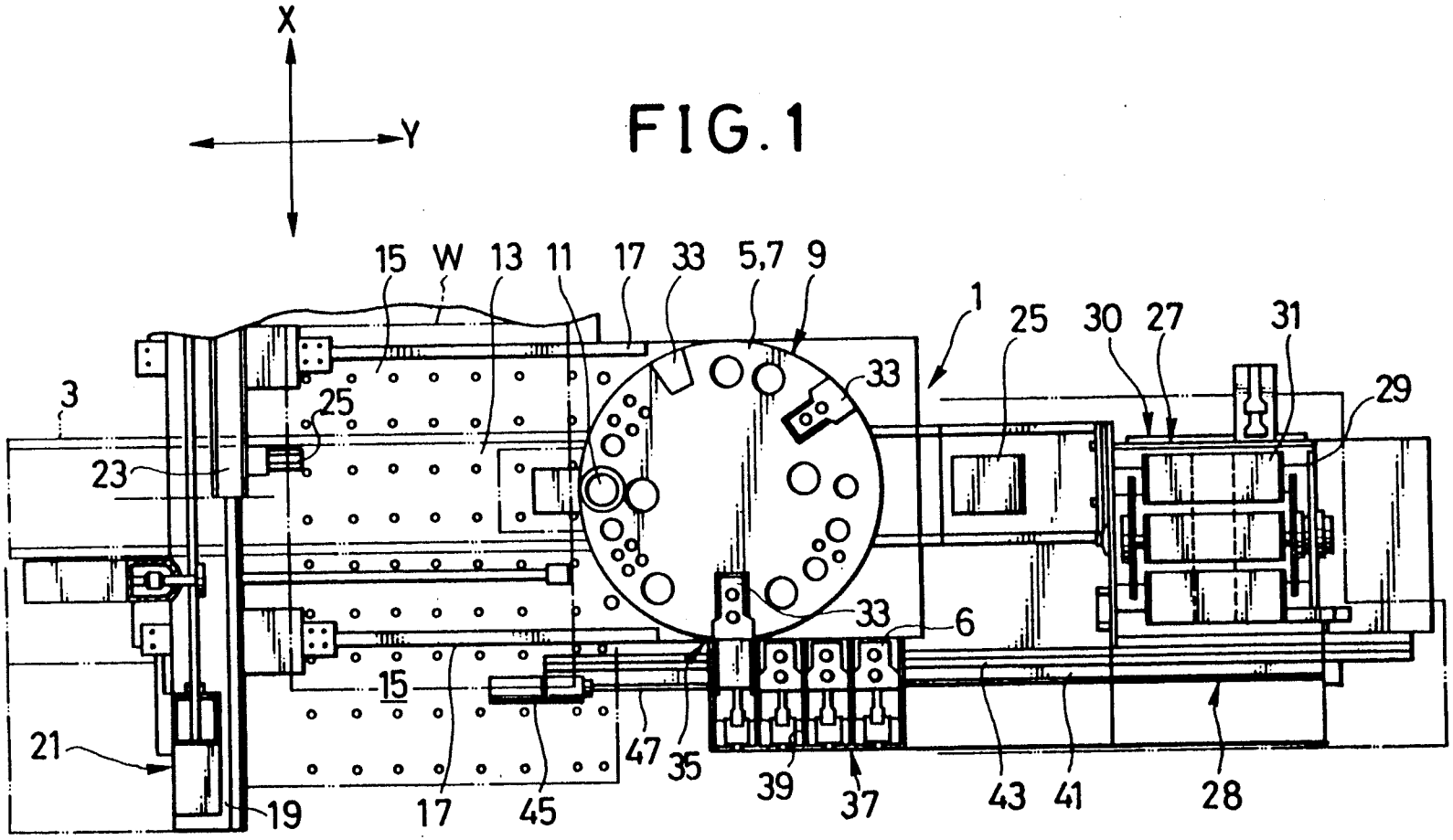
FIG. 1 is a plan of a punch press of the present invention.
Figure 2:
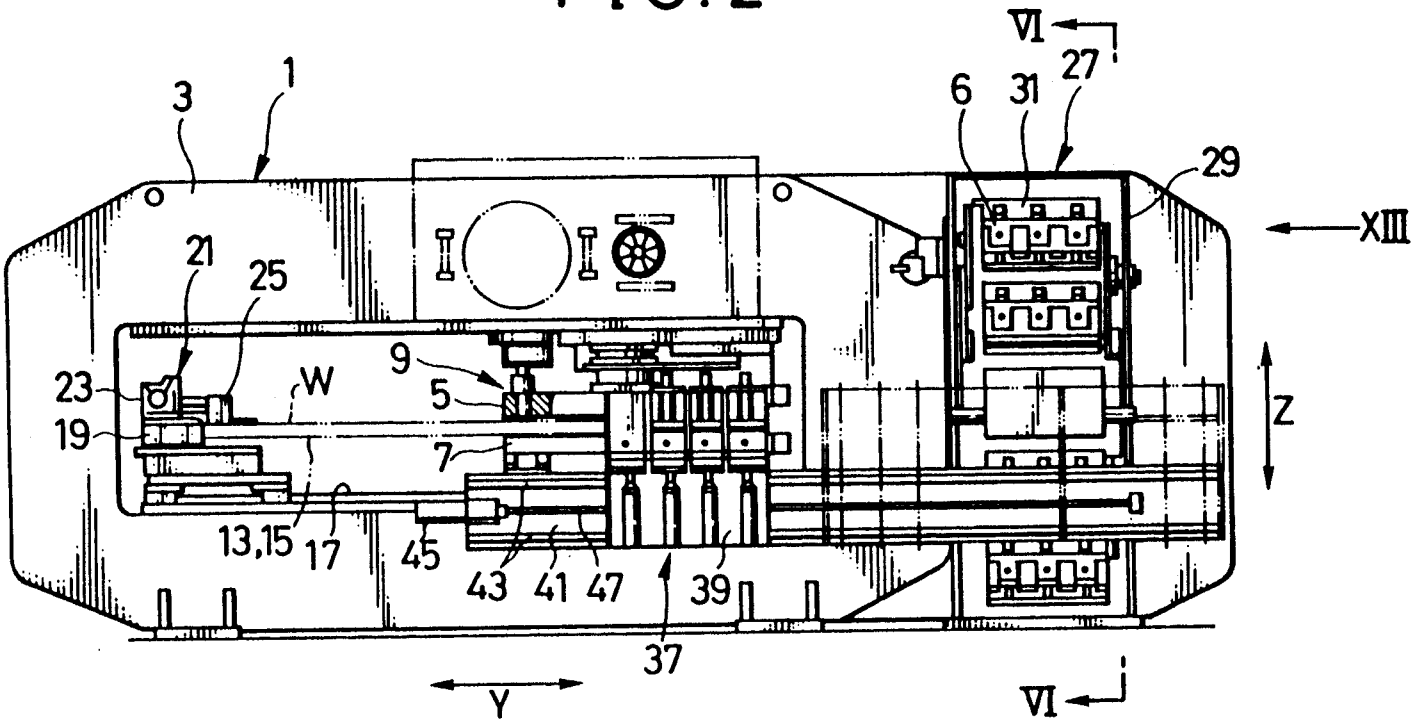
FIG. 2 is a side view of the punch press of FIG. 1.
Figure 25:
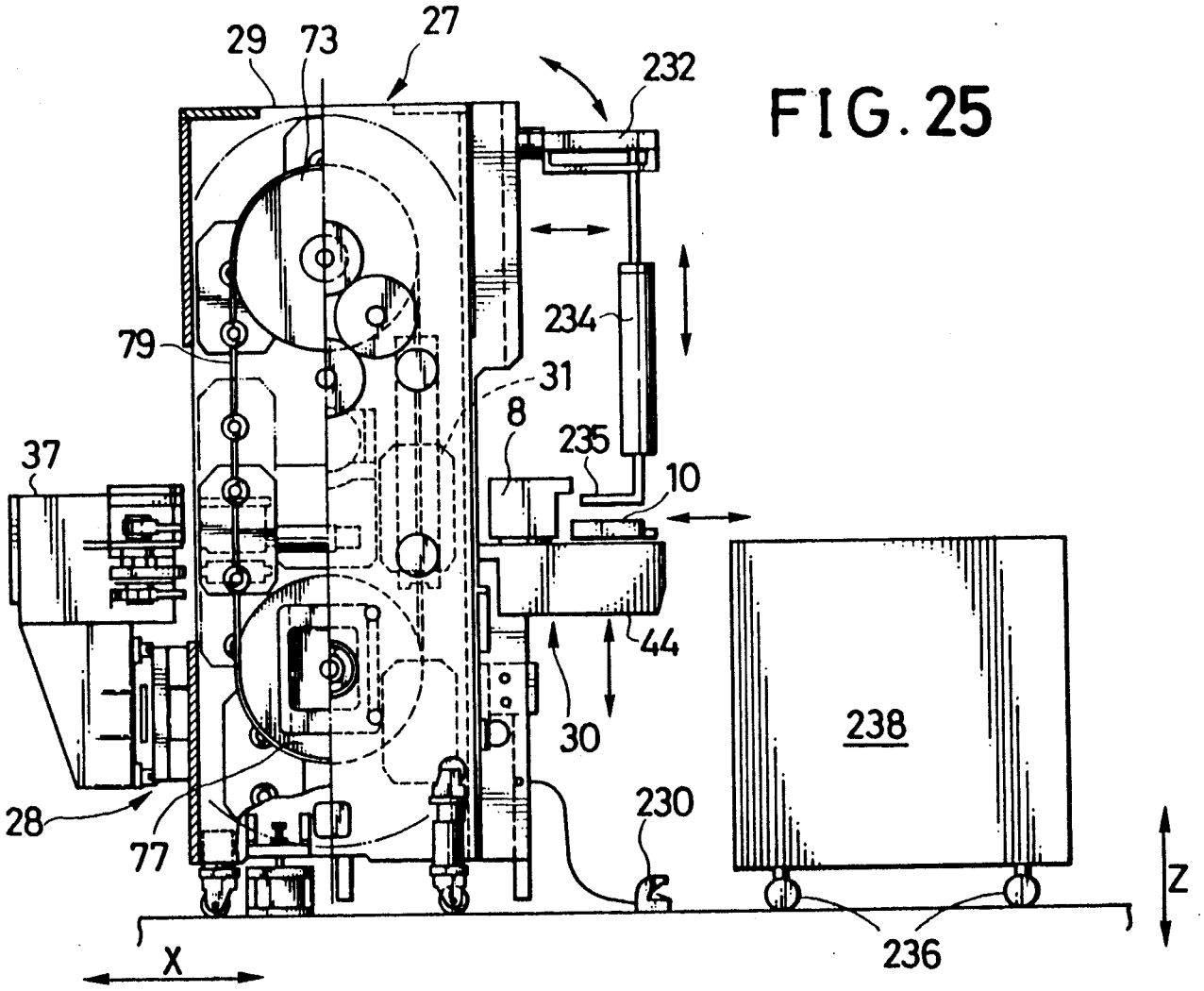
FIG. 25 is an explanatory drawing to show that a device for moving tool assemblies is attached to the tool magazine shown in FIG. 21.

In FIGS. 1 and 2, a turret punch press 1 of the present invention is shown. The punch press is provided with a tool magazine and a tool changer. The general structure of the punch press is explained first. The turret punch press 1 has a frame 3. At the central part of the frame 3 rotatable turrets 9 consisted of an upper turret disc 5 and a lower turret disc 7 are supported by the frame 3. The turrets carry on their perimeter zones a plurality of tool assemblies 6 consisted of one or more punching tool assemblies and one or more die tools. The turrets 9 are rotated by a driving device 25 shown in FIG. 25.

On the left-hand side of the turrets 9 and in the perimeter zones there is provided a punching location 11 above which a striker (not shown) is mounted on the frame 3. The striker is operated by a driving device (not shown) mounted on an upper part of the frame 3 and is moved vertically for hitting the punching tools. Therefore, a workpiece W positioned between the punching tool assemblies and the die tool assemblies is subject to machining.

Under the upper part of the frame 3 there is a center table 13 fixed to the lower part of the frame 3 or the floor. Two tables 15, 15 are arranged beside the center table 13 and are movable transversely or in a direction Y along guides 17 extended in the direction Y.

A carriage base 19 extended in a direction Y is mounted on the movable tables 15. The carriage base 19 is provided with a device 21 for moving and positioning a work W. The work positioning device 21 includes two or more clampers 25 attached to a carriage 23 which is mounted on the carriage base 19. The carriage 23 is slidable along the carriage base 19 in the direction X, while the clampers 25 are slidable on the carriage 23 also in the direction X for changing gripping positions for a work W. The work W held by the clampers 25 is moved in both the directions X and Y by moving the carriage 23 and the two tables 15 in directions X and Y respectively, and a part of the work W to be punched is positioned between the upper and lower turret discs 5 and 7 at the punching location 11.

Adjacent to and on the right-hand side of the frame 3 there is provided a tool magazine 27. In the tool magazine 27 there are a plurality of gondolas 31 supported by frames 29 of the magazine 27. In each of the gondolas 31 one or more pairs of tool assemblies 6 are installed and spaced in the direction Y. The gondolas 31 go around vertically in the magazine 27 and stop at automatically tool changing and manually tool changing locations 28, 30 about which description will be made later.

In the perimeter zones of the turrets there are a plurality of sections 33 each formed in a U-shaped notch. Each of the sections 33 carries a pair of tool assemblies 6. The tool assembly module 6 is attachable and detachable for quick changing. The tool assembly modules 6 are detached from or attached to the turrets 9 at a tool changing location 35 of the punch press 1. The turrets 9 are rotatable for carrying each pair of tool assemblies to the tool changing location 35. In front of the tool changing location 35 is disposed an automatic tool changer 37 which moves in the direction Y. The automatic tool changer 37 has a plurality of housings 39 in which pairs of tool assemblies 6 are carried after the tool assemblies are taken out of the turrets 9 or the gondolas 31 in the tool magazine 27.

Under the automatic tool changer 37, a base 41 extending in the direction Y is fixed to the lower part of the frame 3, and on the base 41 guide rails 43 extending also in the direction Y are mounted. The housings 39 are slidably mounted on the guide rails 43 and are integrally engaged with a ball screw 47 which is engaged at an end with a fixed nut (not shown) and connected at the other end to a driving motor 45 so that the housings 39 can move between the tool changing location 35 and the tool magazine 27 when the ball screw 47 is rotated by operating the motor 45.

By the way, a location 28 in front of the tool magazine 27 in FIG. 1 at which the automatic tool changer 37 stops is called an automatically tool changing location, while a location 30 of the tool magazine 27, opposite the automatically tool changing location 28 is called a manually tool changing location. Each housing 39 is provided with a clamper (not shown) for catching a pair of tool assemblies 6 in the tool carrying section 33 or gondola 31. The automatic tool changer 37 moves between the tool changing location 35 of the punch press 1 and the automatically tool changing location 28 of the magazine 27 for replacing pairs of tool assemblies 6 in the tool carrying sections 33 of the turrets 9 with those stored in the tool magazine 27.

Figure 3:
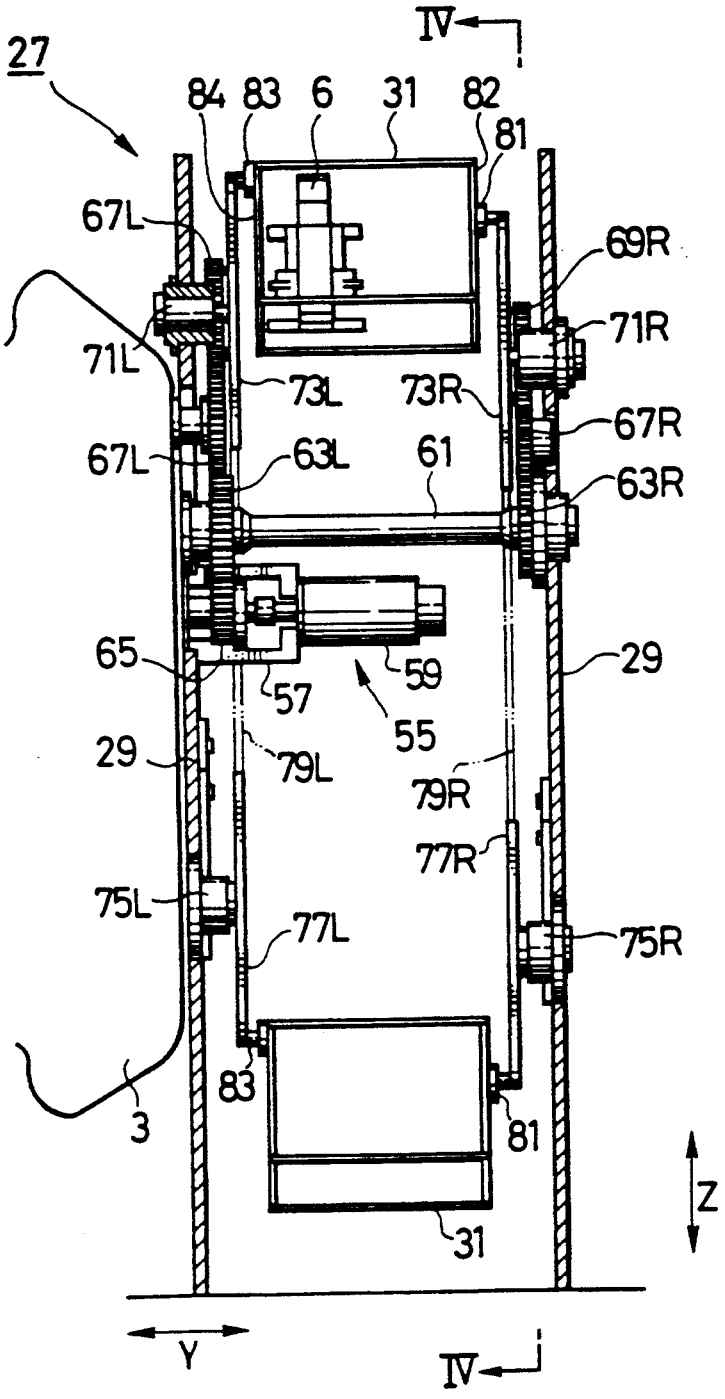
FIG. 3 is an enlarged side view showing a tool magazine of the punch press shown in FIG. 2.
Figure 4:
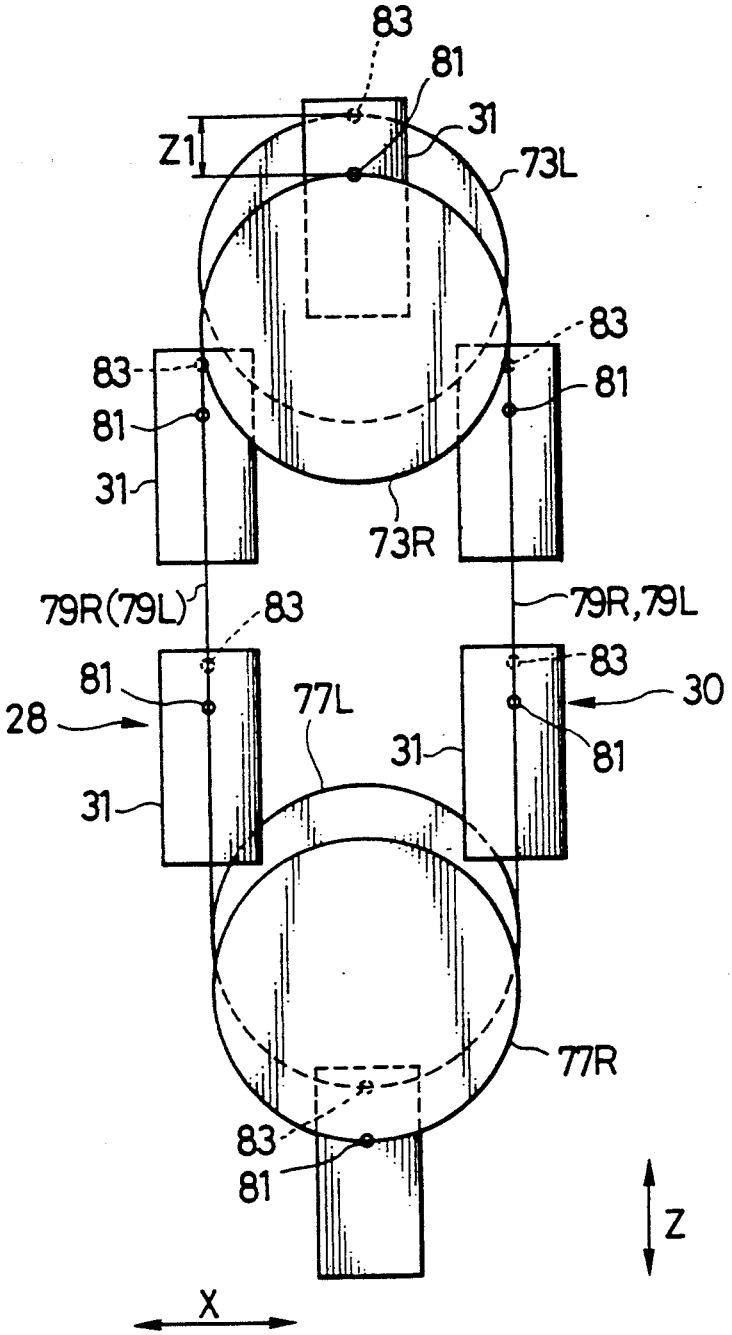
FIG. 4 is a schematic side view taken along an arrow IV—IV in FIG. 3.
Figure 5:
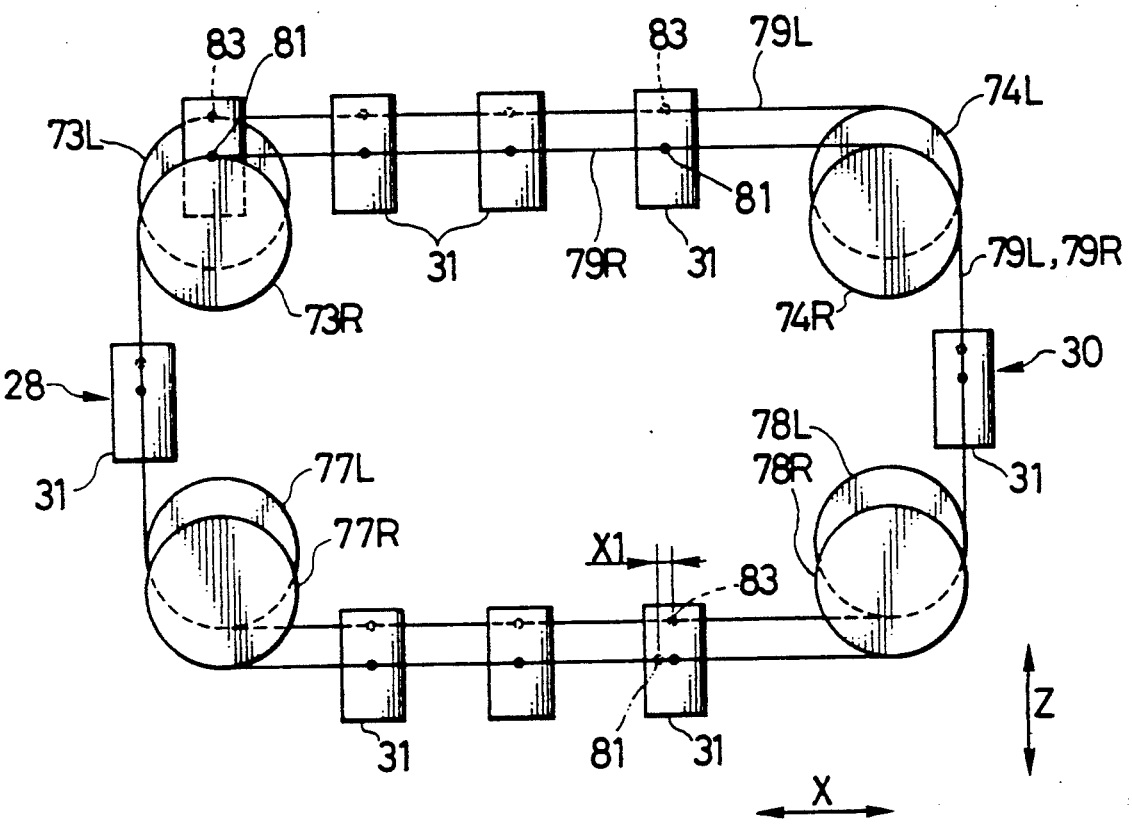
FIG. 5 is a schematic side view of another example of a tool magazine.

In FIG. 3–5, the structure and functions of the tool magazine 27 is explained in detail. In FIG. 3, the frames 29 of the tool magazine 27 are fixed to the frame 3 of the punch press 1, for example, with bolts (not shown). Two groups of sprocket wheels each consisted of an upper and a lower wheels 73L and 77L or an upper and lower wheels 73R and 77R are rotatably mounted on the frames 29 of the tool magazine 27. One group of sprocket wheels 73R, 77R are located in lower positions shifted Z1 in height from the other group 73L, 77L as clearly shown in FIG. 4.

The upper and lower sprocket wheels 73L and 77L and 73R and 77R are connected with each other with endless chains 79L and 79R respectively so that the chains 79L and 79R can rotate around the wheels when the upper sprocket wheels 73L and 73R are rotated. The plurality of gondolas 31 are pivotally attached to and suspended from and between the two chains 79L, 79R, and spaced and kept in upright position in the loop of chain. Each gondola is supported at two supporting points 81, 83 on its side walls 82, 84. The supporting points 81, 83 on the gondola 31 shift the same distance in height from each other as the height difference Z1 of the two groups of sprocket wheels 73L, 77L and 73R, 77R.

A driving device 55 for rotating the upper sprocket wheels 71L and 71R is mounted on the frames 29 of the tool magazine 27. The driving device 55 has a final reduction gear 57 to which a driving motor 59 such as a servo motor is connected.

Above the driving device 55 there a transverse shaft 61 is rotatably mounted on the frames 29 of the magazine 27. To ends of the shaft 61 gears 63L and 63R are fixed respectively. The gear 63L is engaged by a gear 65 attached to the final reduction gear 57. In addition, the gears 63L and 63R are engaged respectively by gears 67L and 67R which are rotatably mounted on the frames 29 of the magazine 27, and the gears 67L and 67R are engaged with gears 69L and 69R of the sprocket wheels 73L and 73R respectively.

On the other hand, under the driving device 55 there the sprocket wheels 77L and 77R are rotatably mounted through their bearings 75L and 75R respectively on the frames 29 of the magazine 27. The sprocket wheels 77L and 77R are followers.

According to the above mentioned structure, the upper sprocket wheels 73L, 73R are rotated through the final reduction gear 57, gears 65 and 63L, the shaft 61, and the gears 63R, 67L, 67R, 69L, and 69R when the motor 59 is driven, and consequently the endless chains 79L and 79R are moved around.

As a result, the gondolas 31 go around in the magazine 27. The gondolas 31 do not turn upside down even if they move transversely where they are subject to horizontal force or overturning moment since they are supported at the supporting points 81, 83 which differ from each other in height. Hence, the gondolas can move vertically and horizontally keeping their upright position in a loop. This means that the pairs of tool assemblies in the gondolas are kept in upright position. Therefore, an operator at the manually tool changing location can easily change the tool assemblies in the magazine, and these replaced tool assemblies are taken out while kept also in upright position by the automatic tool changer at the automatically tool changing location.

In FIG. 5, a modified arrangement of sprocket wheels is shown. In this arrangement, each group of sprocket wheels has four wheels 73L, 74L, 77L and 78L (or 73R, 74R, 77R and 78R), and more gondolas move around in a vertical rectangular loop, wherein more tool assemblies may be carried in the gondolas and wherein both automatically and manually tool changing locations may be positioned more appropriately. The left-hand side is the automatically tool changing location 28, and the right-hand side is the manually tool changing location 30.

The supporting points 81 and 83 are shifted from each other in height and may also be shifted transversely as shown by a dimension X1 in order to make gondolas balanced or move further appropriately.

In FIGS. 6–12, another or a second example of the tool magazine 27 for a punch press is described.

Figure 6:
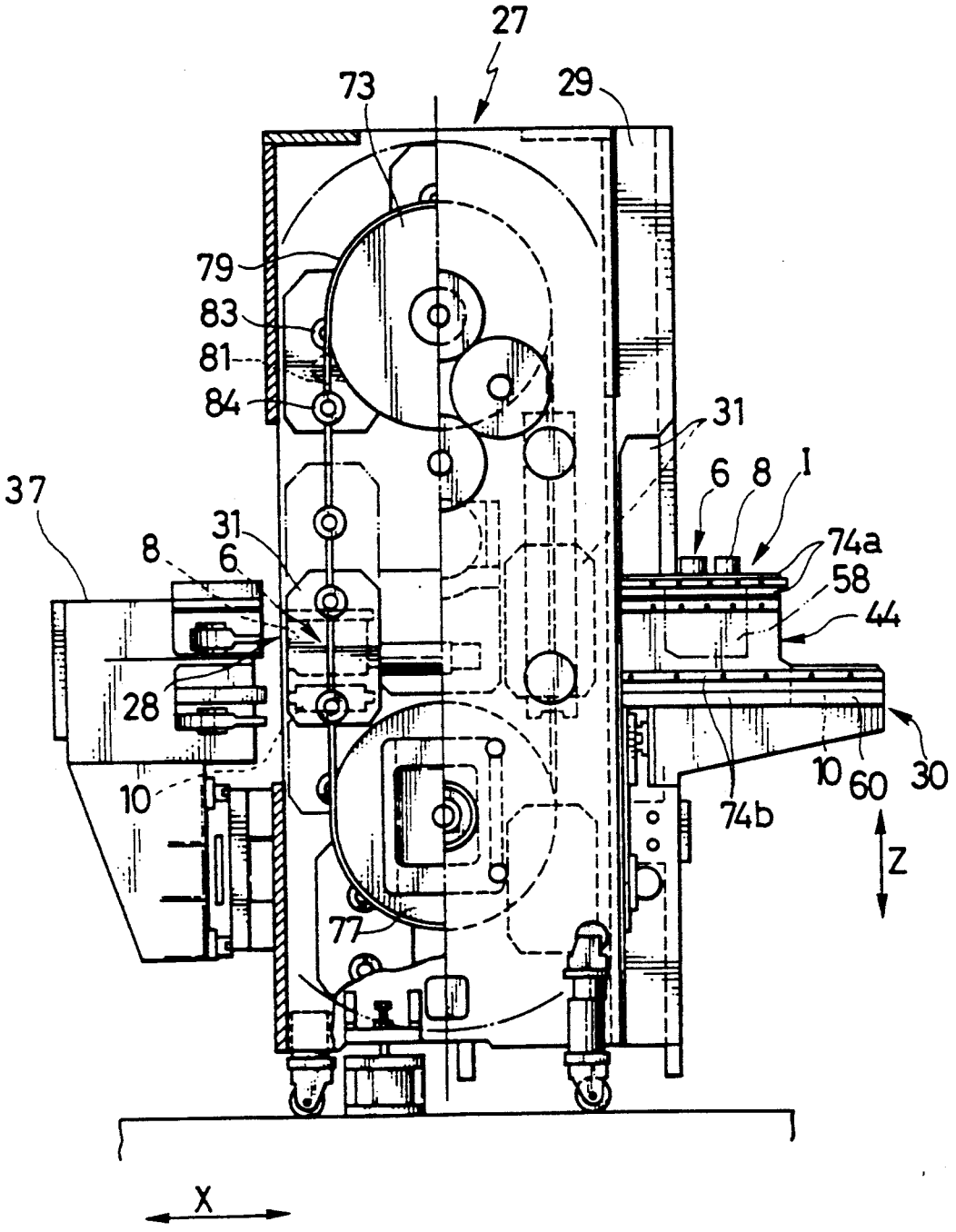
FIG. 6 is an enlarged sectional side view taken along an arrow VI—VI in FIG. 2, showing a further example of a tool magazine.

In FIG. 6, the magazine 27 includes two pairs of sprocket wheels 73, 77 rotatably mounded on frames 29 of the magazine 27. Each pair of the sprocket wheels 73, 77 are connected by an endless chain 79 so that the endless or looped chain 79 can go around when the upper sprocket wheel 73 is rotated by a motor (not shown) as explained above. A plurality of gondolas 31 are pivotally attached to and spaced in the looped chains 79, that is, supported by and between the chains 79. The two pairs of sprocket wheels 73, 77 are positioned at the same height as each other, and each gondola 31 is supported at four supporting points 83, 84 two by two on each side of the gondola 31. The supporting points 83, 84 are arranged symmetrically. However, the two pairs of wheels 73, 77 may shifted from each other, and the supporting points may be shifted in height as indicated by reference numerals 81 and 83 as described above.

The left-hand side is an automatically tool changing location 28 of the magazine 27, where an automatic tool changer 37 of the punch press is staying. The right-hand side is a manually tool changing location 30 at which a table 44 is attached to the magazine 27. The table 44 is slidable in the direction Y.

Figure 7:
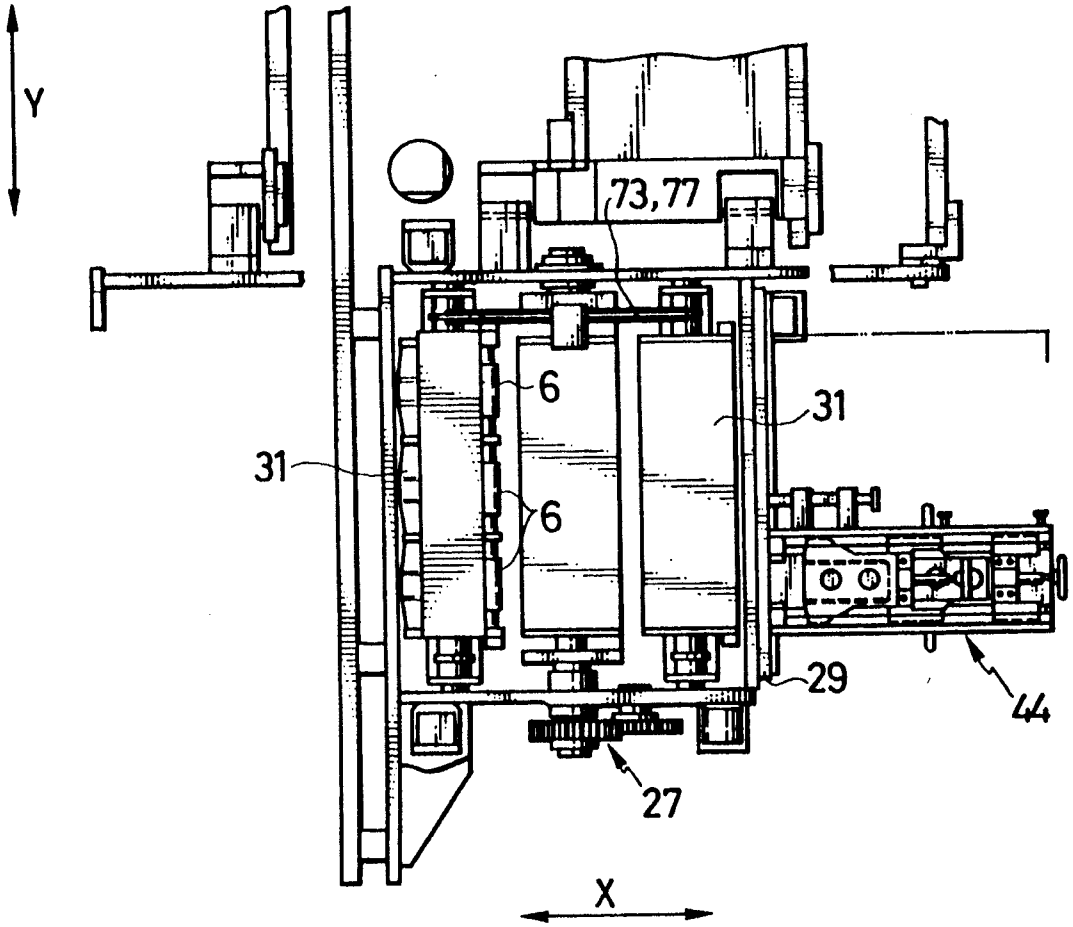
FIG. 7 is a plan of the tool magazine of FIG. 6.
Figure 8:
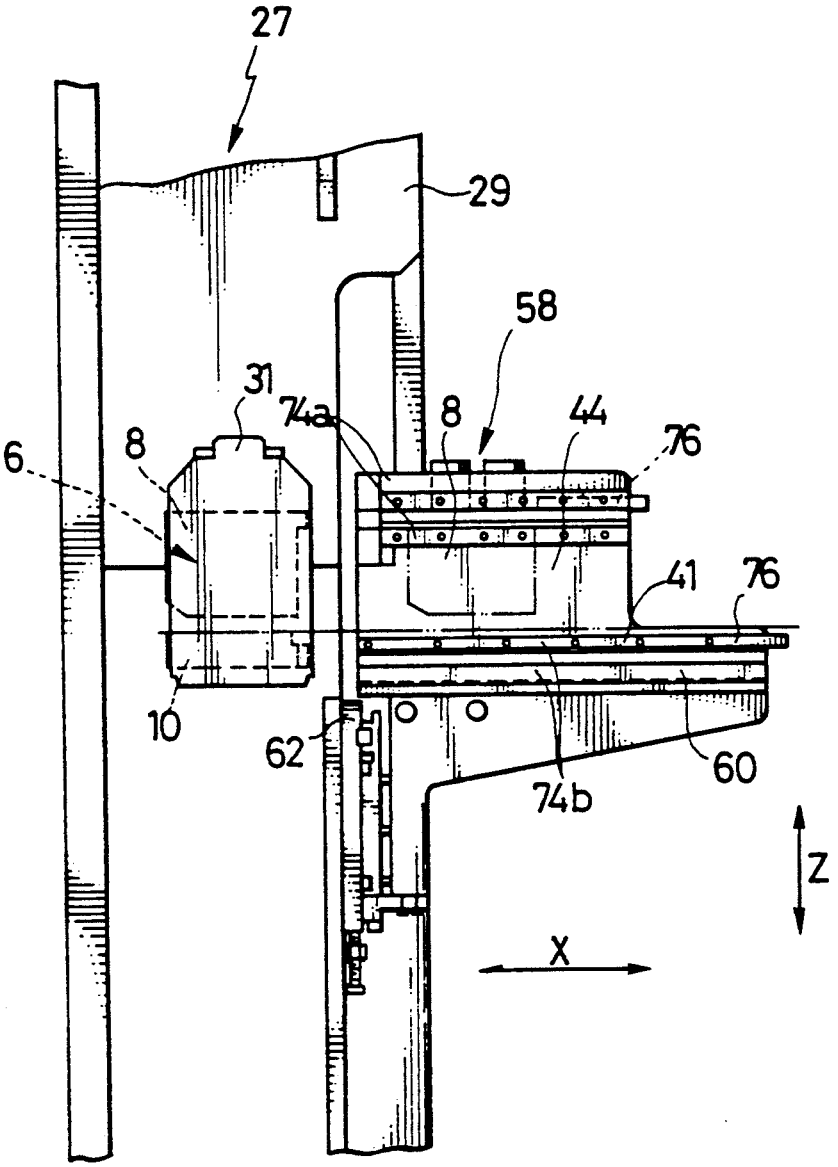
FIG. 8 is an enlarged side view of a part shown by an arrow I in FIG. 6.
Figure 9:
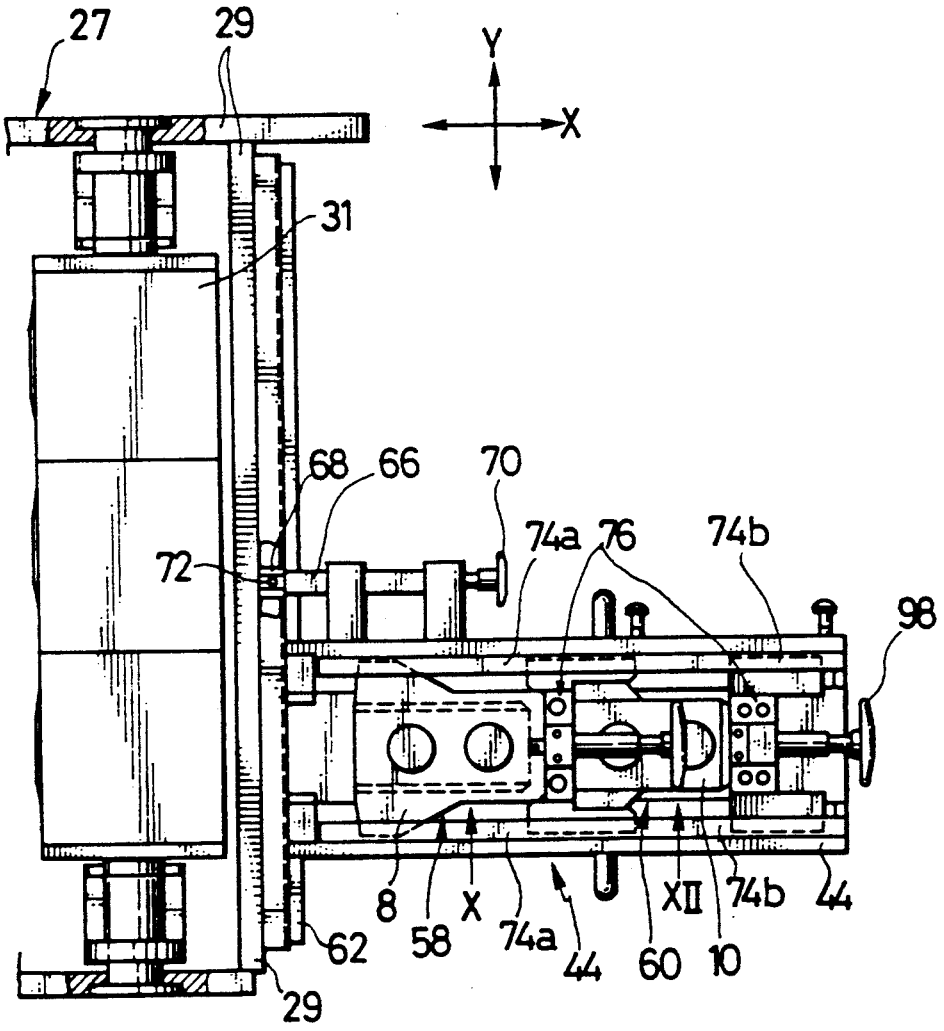
FIG. 9 is a plan of the part shown in FIG. 8.

In FIGS. 7–9, a plurality of, for example three pairs of tool assemblies 6 are stored in each gondola 31. A guide member 62 (FIGS. 8 and 9) such as a LM guide extending in the direction Y is fixed to the frame 29 of the magazine 27, and the table 44 is slidable along the guide member 62 in order to stop in front of each of the three tool assemblies 6 stored in the gondola 31 which is staying at the manually tool changing position 30, for taking out the tool assemblies 6 of the gondola 31. To one side of the table 44 attached is a bolt 66 (FIG. 9) for fixing the table 44 in desired positions in front of the gondola 31. The bolt 66 is provided at a distal end with an engaging pin 68 and at a proximal end with a handle 70.

On the other hand, holes 72 are formed in the guide member 62. The pin 68 of the bolt 66 is inserted in one of the holes 72 by means of the handle 70, and as a result the table 44 is fixed in front of the tool assemblies where the center line of the table coincides with that of the tool assemblies.

The table 44 is shaped like a step, and rails 74*a* are attached to sides of an upper part of the step for guiding the punching tool assemblies or upper die holder 8 when it is taken out of the gondola 31, while rails 74*b* are attached to sides of a lower part of the step for guiding the die tool assemblies or lower die holder 10 when it is taken out of the gondola 31.

Two setting devices 76 are slidably mounted on the upper and lower rails 74*a* and 74*b* respectively for drawing out and pushing the tool assemblies 6 into the gondola 31.

Figure 10:
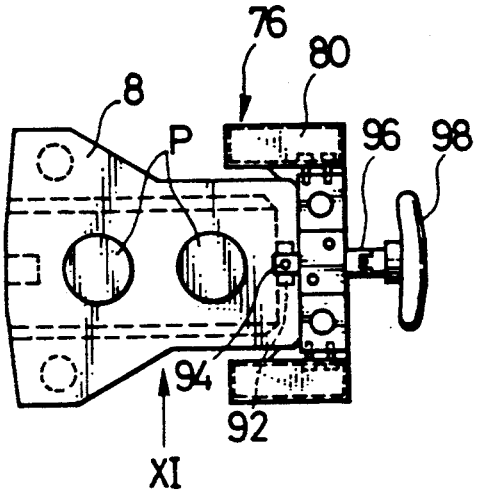
FIG. 10 is an enlarged plan of a part shown by an arrow X in FIG. 9.
Figure 12:
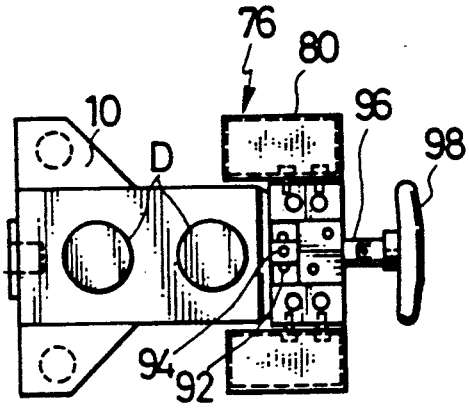
FIG. 12 is an enlarged plan of a part shown by an arrow XII in FIG. 9.
Figure 11:
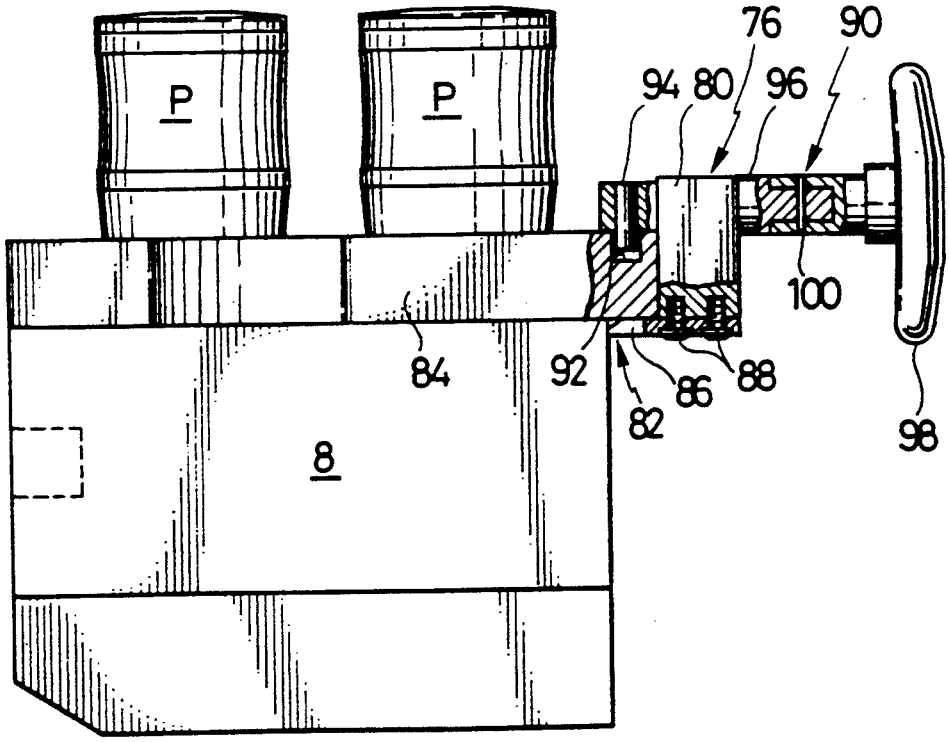
FIG. 11 is an enlarged side view taken along an arrow XI in FIG. 10.
Figure 13:
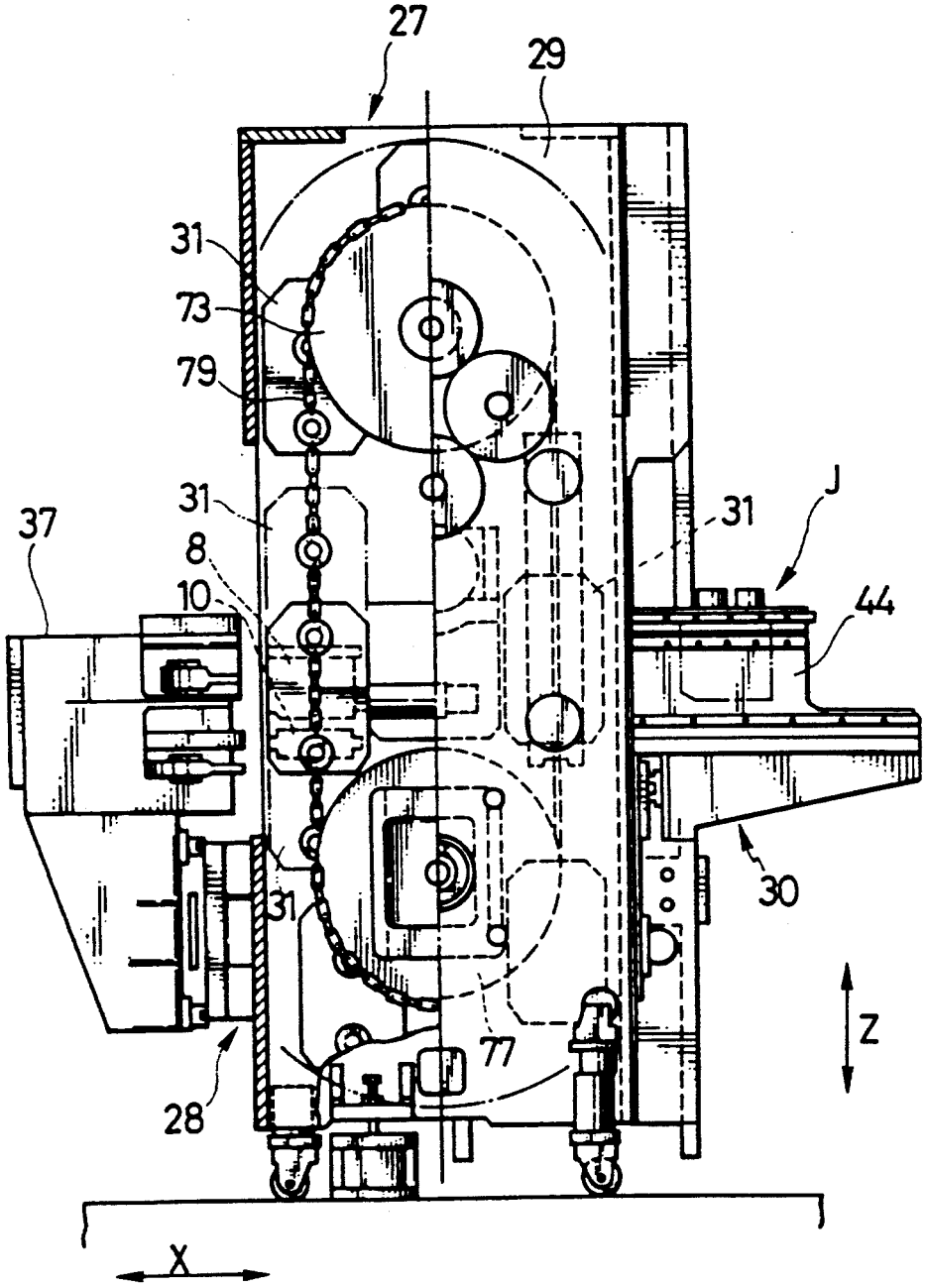
FIG. 13 is an enlarged side view taken along an arrow XIII in FIG. 2, showing a further example of a tool magazine.

In FIGS. 10–12, here, description will be made about the setting devices 76 in detail. In FIGS. 10 and 11, the setting device 76 and the upper die holder 8 which includes two punching tools P are shown. The setting device 76 includes a main body 80 which slidably engages with rails 74*a* of the upper die holder 8, a small piece of plate 82 fixed to the bottom of the main body 80 with bolts 88, and a shaft 96. The shaft 96 is provided at a distal end with a pin 94 which engages with a groove 92 formed in the shape of a crescent in an upper surface of a flange of the upper die holder 8, and is provided at a proximal end with a handle 98. The handle 98 is fixed to the proximal end with screws 100. The shaft 96 is rotatably supported in the main body 80. The device 76 shown in FIG. 12 and used for the lower die holder 10 which includes die tools D is the same as that used for the upper die holder 8.

In order to push the upper and lower die holders 8 and 10 into the gondola 31, first, the table 44 is moved to a predetermined place and fixed there by engaging the pin 68 of the bolt 66 with the hole 72 of the guide 62 as described above with reference to FIG. 9. Then, the setting devices 76 are moved until these come into contact with the upper and lower holder 8 and 10, and the handles 98 are turned over. Consequently, the shafts 96 are rotated and the pins 94 of the shafts 96 are engaged with the crescent-shaped grooves 92. The plates 82 support bottom surfaces of the flange 84 of the die holders 8 and 10.

Then, the die holders 8 and 10 are slid along the guides 74*a* and 74*b* and installed in the gondola 31 when the operator pushes the handles 98. The die holders 8 and 10 are then disengaged from the pins 94 when the shafts 96 are rotated and detached from the grooves 92. The die holders 8 and 10 are drawn out of the gondola 31 in a similar manner.

The upper and lower die holder 8 and 10 are drawn out of gondola along the rails 74*a* and 74*b* one by one, and then placed in the different positions 58, 60 (FIGS. 8 and 9) on the table 44. The positions 58, 60 are not superimposed. Therefore, the operator can see both die holders 8 and 10 at the same time and handle them easily and safely.

In FIGS. 13–20, a further or third example of the tool magazine 27 is described. In the magazine 27 a plurality of tool mounting gondolas 31 (FIG. 13) move around as explained above. The same reference numerals are used for devices or functional elements here in FIG. 13 as those used for the second example of the tool magazine shown in FIG. 6. The right-hand side is a manually tool changing location 30 at which a table 44 is attached to the magazine 27.

Figure 14:
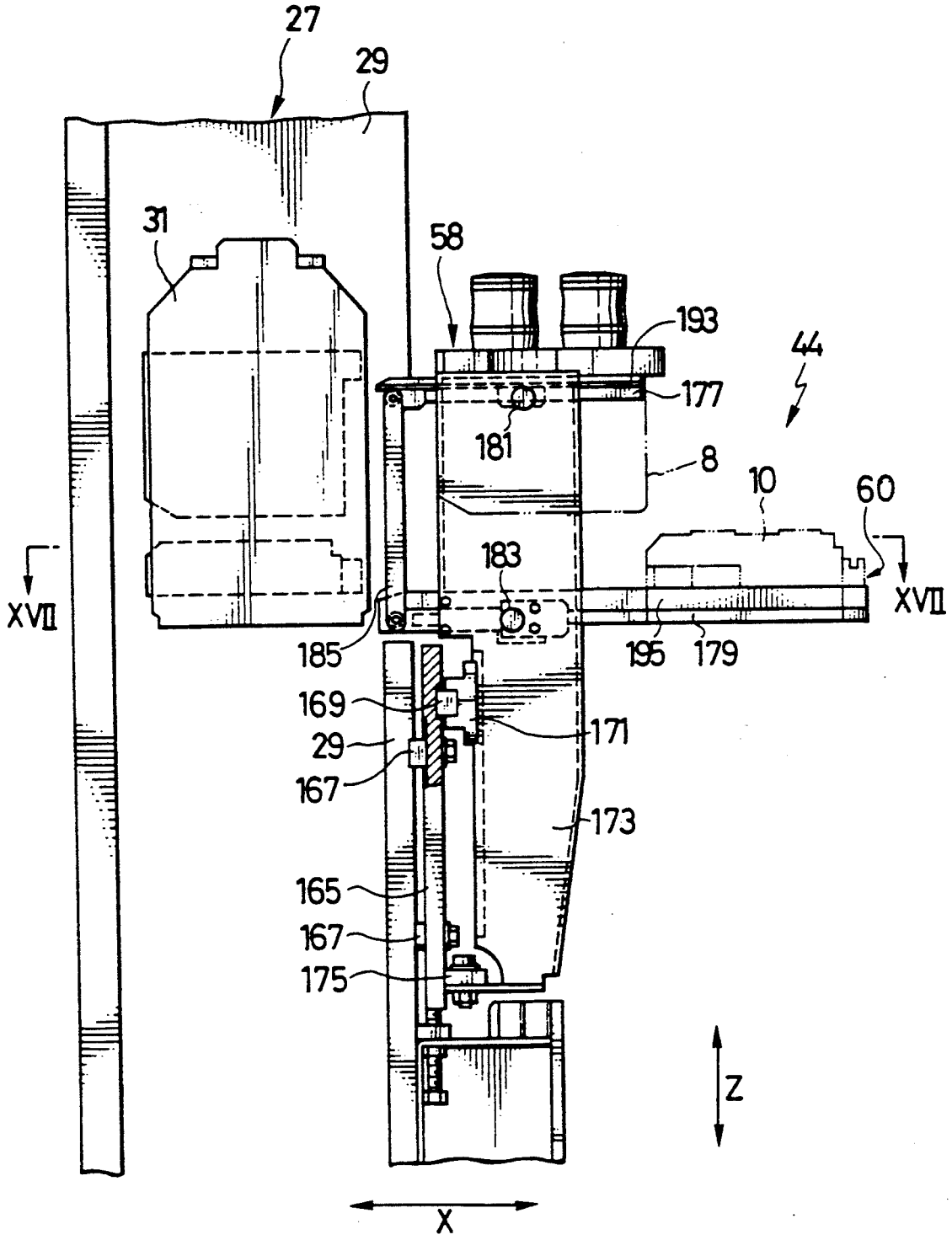
FIG. 14 is an enlarged side view of a part shown by an arrow J in FIG. 13.
Figure 15:
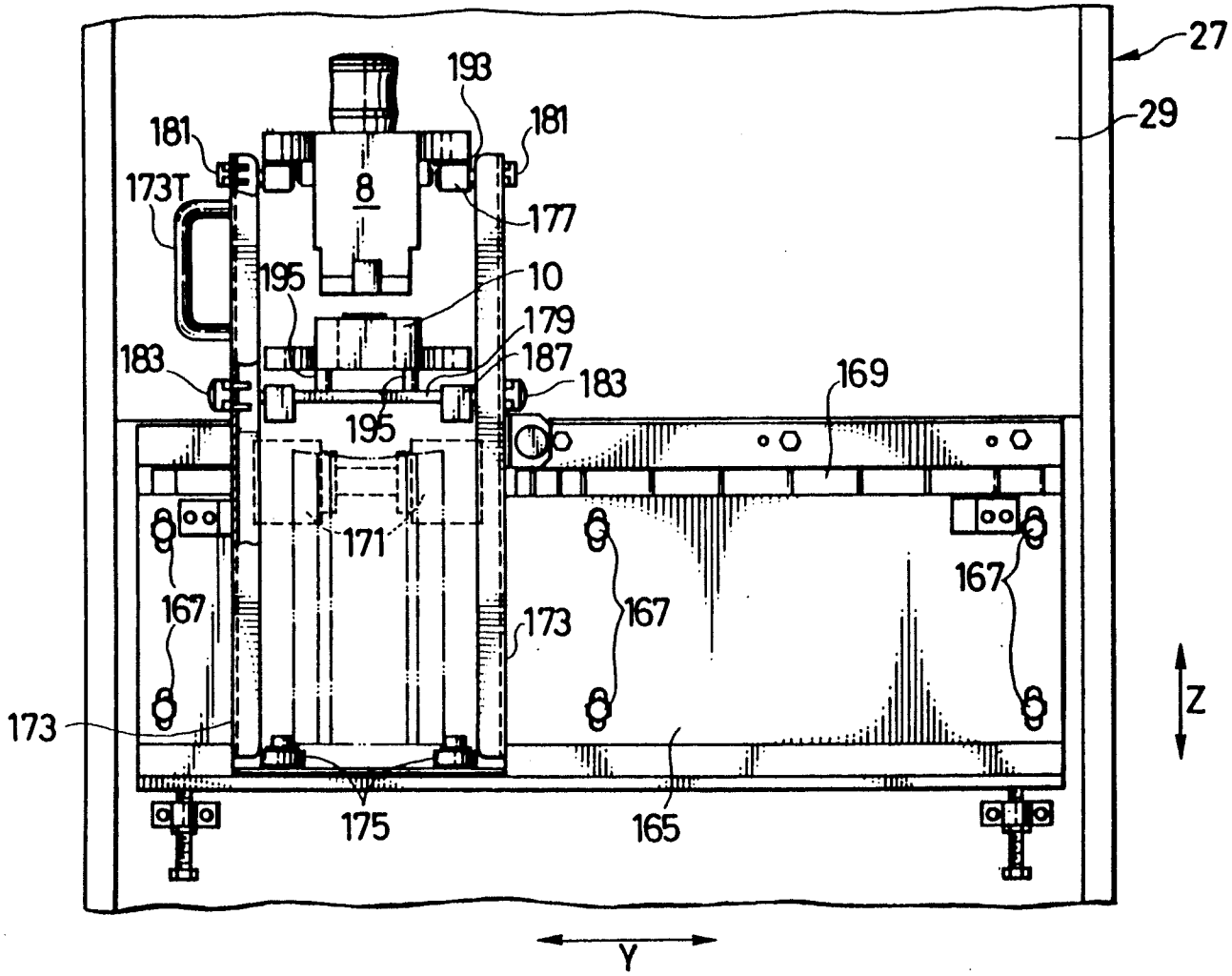
FIG. 15 is a front view of the part shown in FIG. 14.
Figure 16:
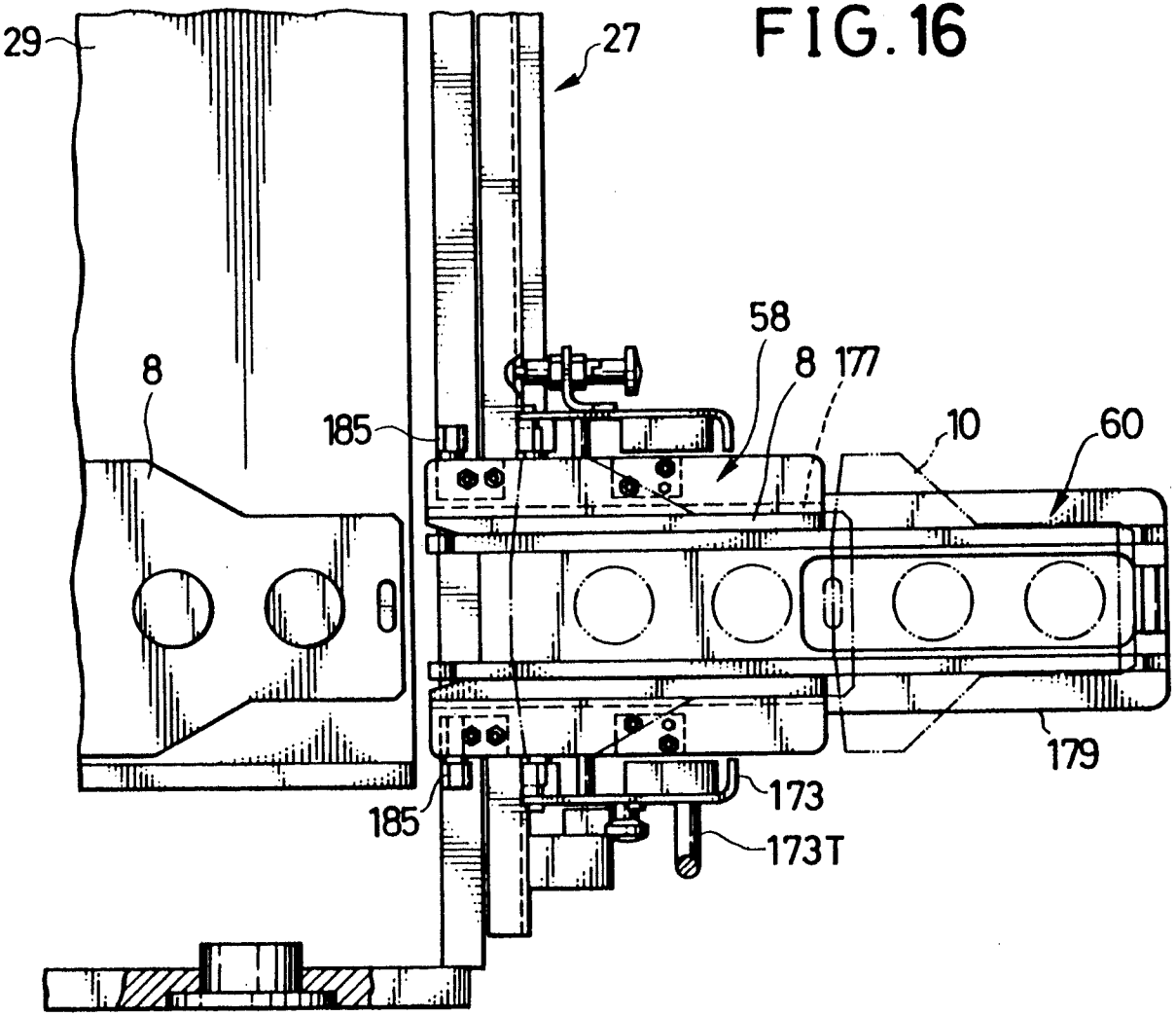
FIG. 16 is a plan of the part shown in FIG. 14.

In FIGS. 14–16, the structure of the table 44 is explained. A plate 165 extending in the direction Y is fixed to frames 29 of the magazine 27 with bolts 67. A guide rail 169 extending in the direction Y is fixed to an upper part of the plate 165, and two upright plates 173 are slidably mounted on the guide rail 169 through a guide member 171. A grip 173T is fixed to at least one of the upright plates 173 as shown in FIG. 15, and a pair of rollers 175 are mounted on lower parts of the upright plates 173 as shown in FIGS. 14 and 15. The rollers 175 rotatably contact with the plate 165 fixed to the frame 29 of the magazine 27. Accordingly, the upright plates 173 are moved horizontally while guided by the guide rail 169 and the rollers 175 when an operator pulls or pushes the grip 173T.

Figure 17:
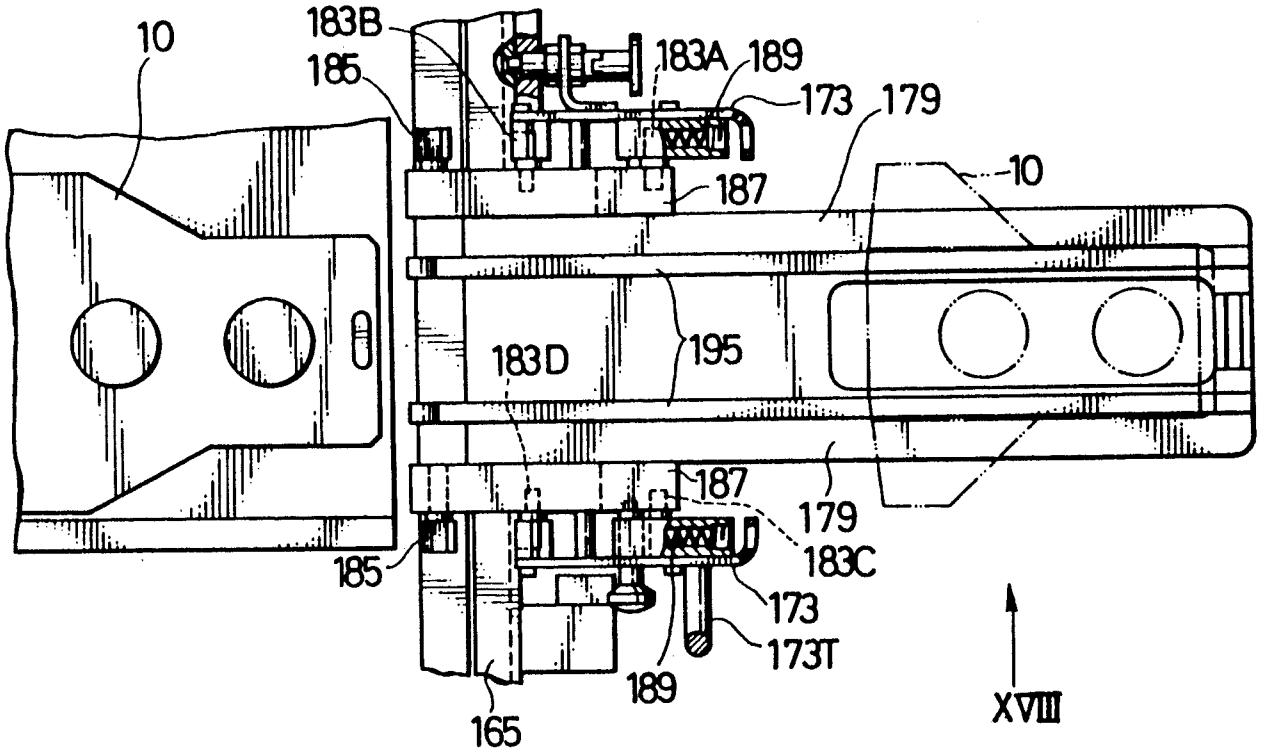
FIG. 17 is an enlarged plan view taken along a line XVII—XVII.

Two horizontal plates 177 and 179 arranged at two different heights for supporting the upper and lower die holders 8 and 10 respectively are placed between the two upright plates. The upper table plate 177 is rotatably supported in the upright plates 173 with pins 181, while the lower table plate 179 is supported in the upright plates 173 with pins 183 through blocks 87 fixed to edges of the lower table plate 179. The upper and lower table plates 177 and 179 are connected to each other by vertical links 185 in a rotatable manner with respect to the vertical links 185. The lower table plate 179 is also supported between the upright plates 173 with four pins 183A, 183B, 183C, and 183D which are fixed to the blocks 187 as shown in FIG. 17.

Figure 18:
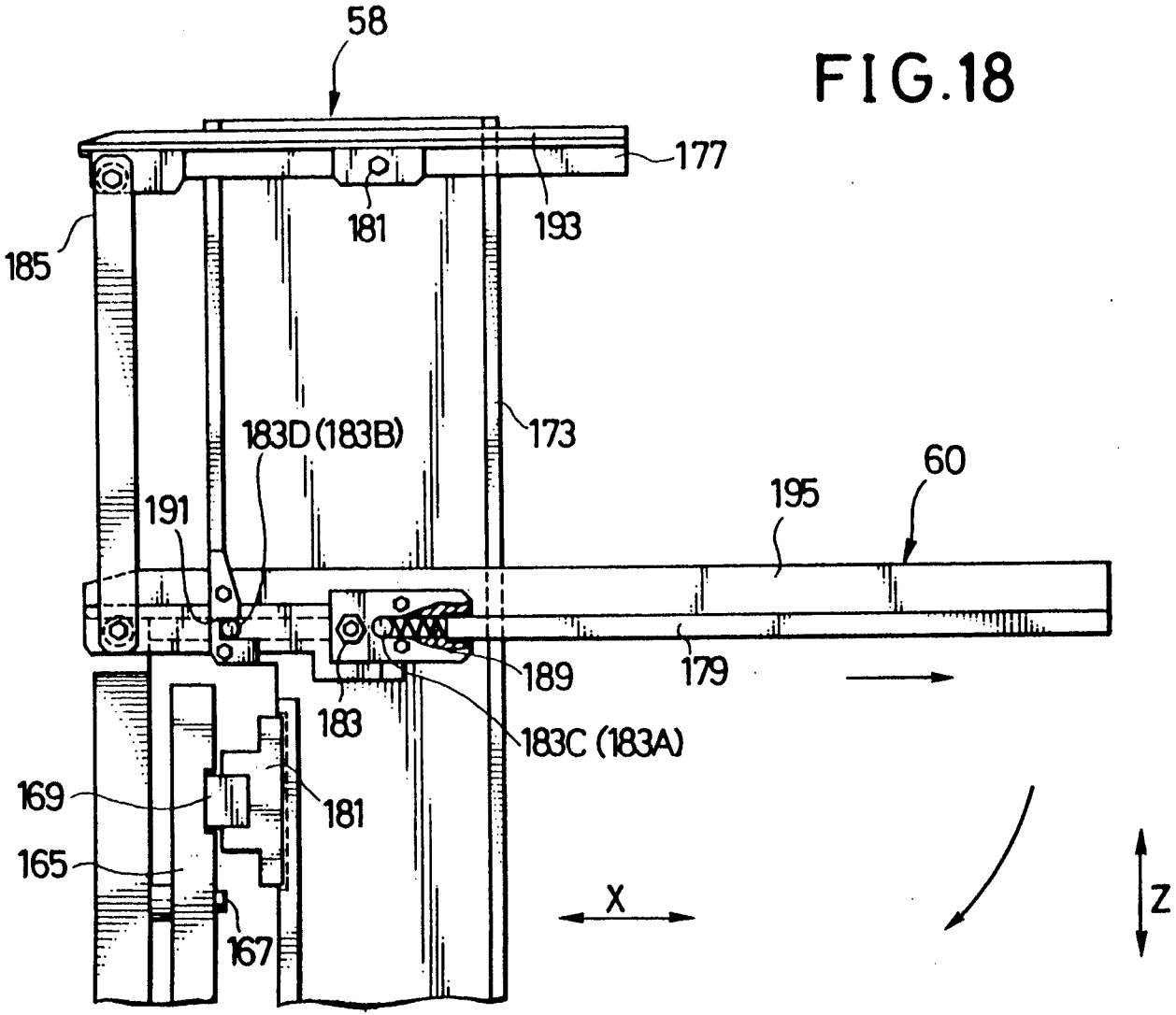
FIG. 18 is an enlarged view taken along an arrow XVIII.

The pins 183C and 183A are normally thrust to the left by contracted coil springs 189 as shown in FIG. 18, and as a result pins 183D and 183B are thrust to the left through the blocks 187 and pushed in the square notches 191 formed in the upright plates 173. Therefore, the table plates 177 and 179 are stable.

On the upper and lower table plates 177 and 179 mounted are a plurality of guide rails 193 and 195 extending in the direction X. The upper and lower die holder 8 and 10 are moved horizontally on the guide rails 193 and 195 respectively and placed in two different positions 58 and 60 on the table 44 when they are drawn out of the gondola 31 or pushed in the gondola 31. The two positions 58 and 60 are not superimposed, and therefore the operator can see both the upper and lower die holder 8 and 10 at the same time and handle them easily and safely.

Figure 19:
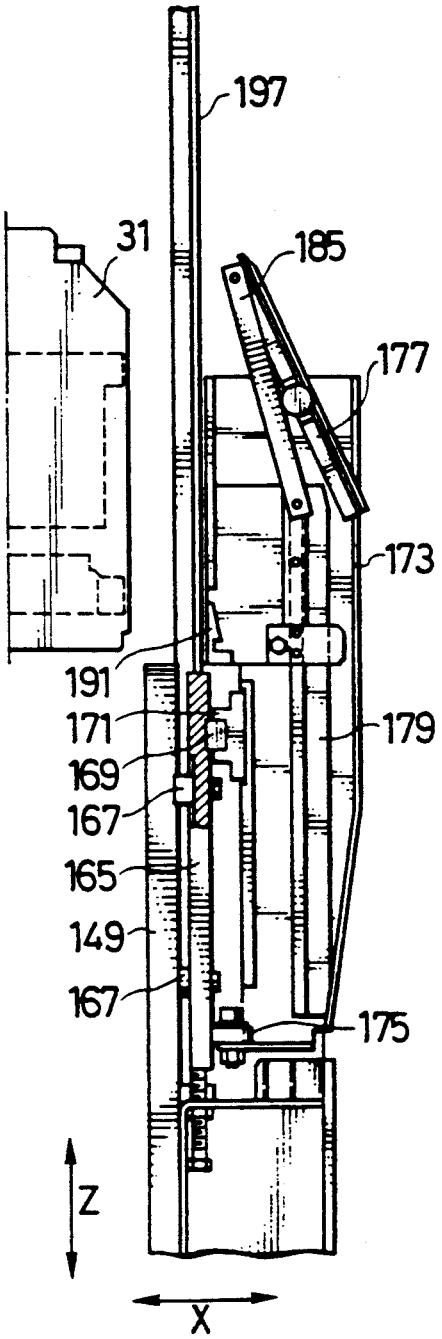
FIGS. 19 and 20 are explanatory drawings to show folding up of a table of the tool magazine shown in FIG. 13.
Figure 20:
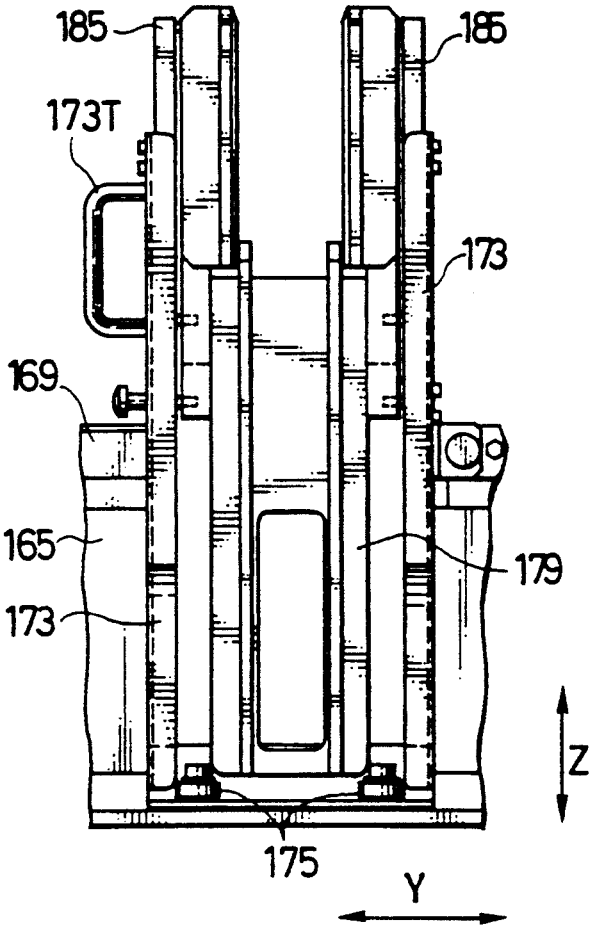

The table 44 is designed as mentioned above, so that the pins 183C and 183A are disengaged from the square notches 91 when the lower table plate 179 is pulled to the right (FIG. 18). Then, lower table plate 179 rotates clockwise, and the vertical links 185 moves rightwards and upwards causing the upper table plate 177 to rotate clockwise. In other words, the table 44 is fold up as shown in FIGS. 19 and 20. A vertical door or rolling door 197 is pulled downwards in order to close the tool magazine 27 for the operator's safety since the gondolas 31 may be operated in the magazine 27. The table 44 folded up is set in the working position by rotating the lower table plate 179 counterclockwise and by engaging the locking pins 183D and 183B with the engaging notches 191.

Figure 21:
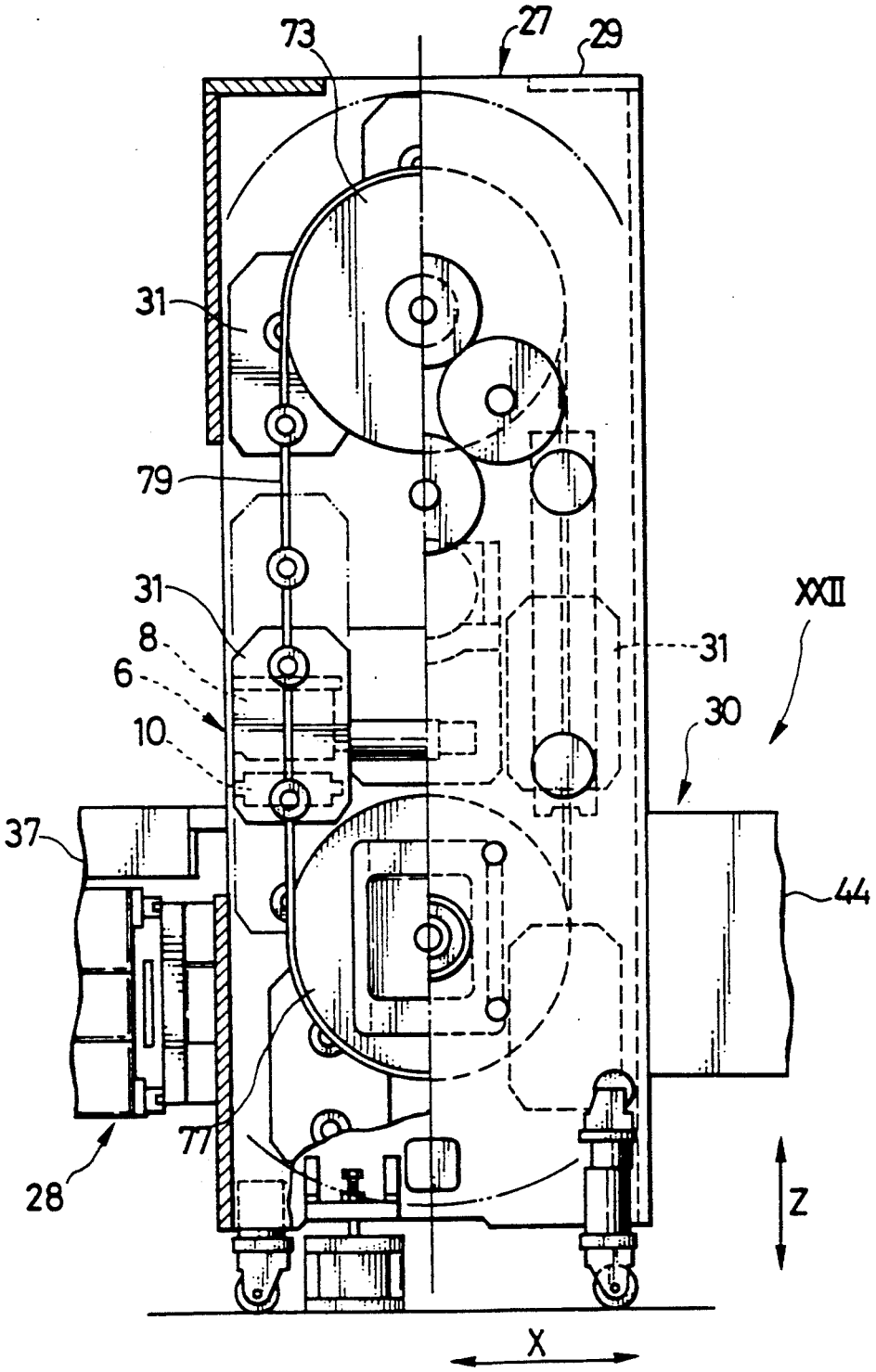
FIG. 21 is an enlarged side view showing a further example of a tool magazine.
Figure 22:
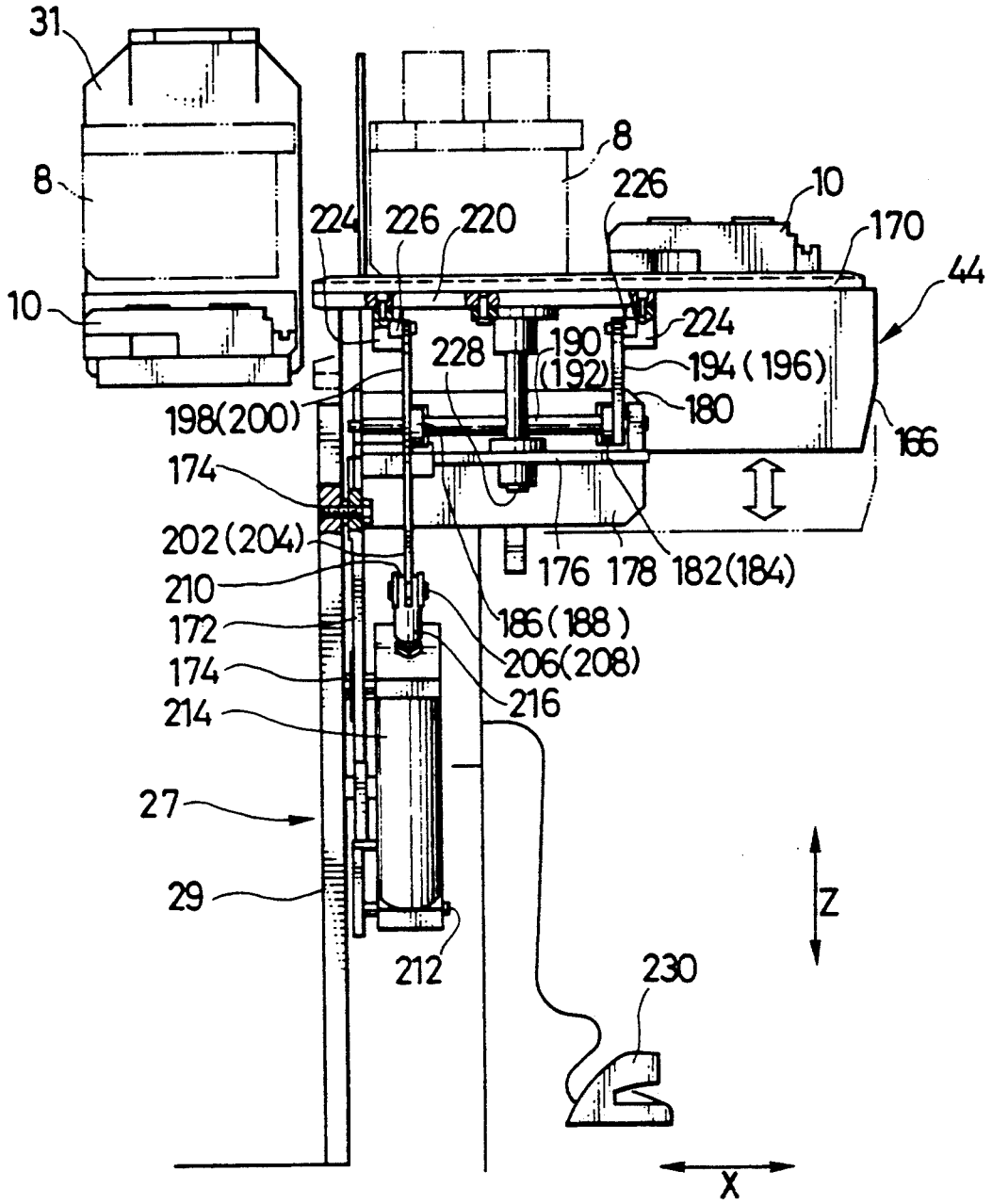
FIG. 22 is an enlarged side view of a part shown by an arrow XXII in FIG. 21.
Figure 23:
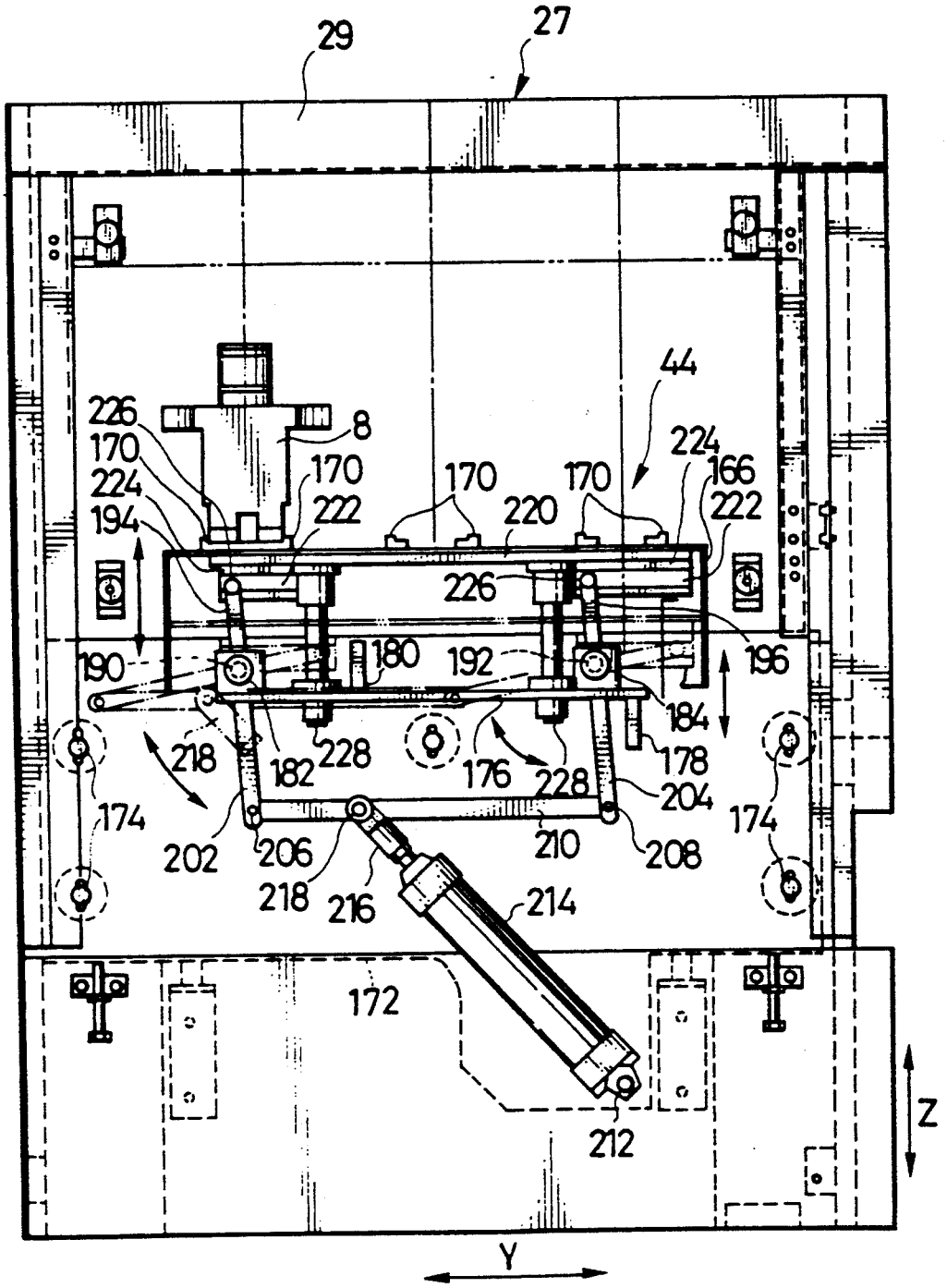
FIG. 23 is a front view of the part shown in FIG. 22.
Figure 24:
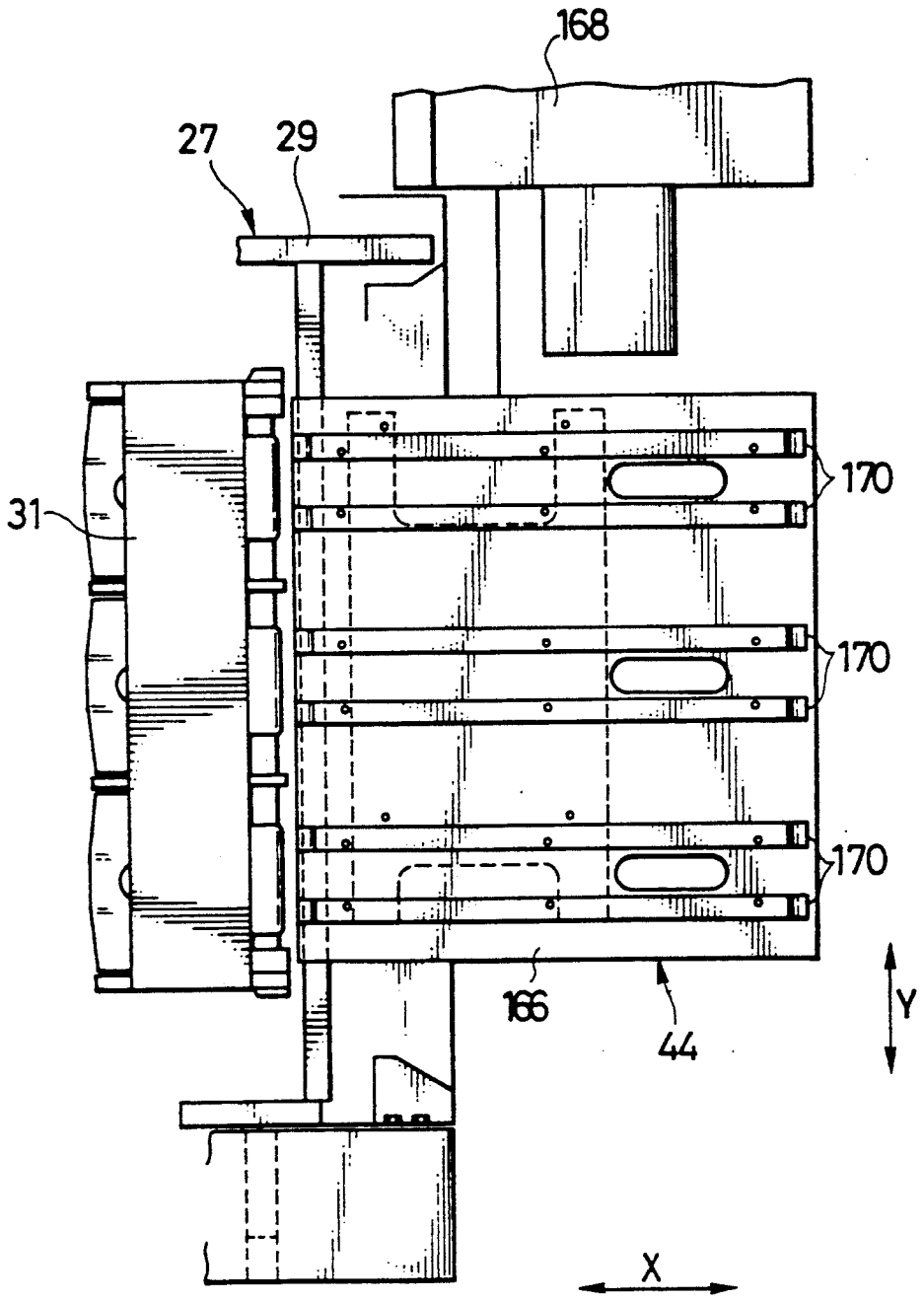
FIG. 24 is a plan of the part shown in FIG. 22.

In FIG. 21–25, a further or fourth example of the tool magazine 27 is described. In the magazine 27 a plurality of tool mounting gondolas 31 move around as shown in FIG. 21 and as explained above. The same reference numerals are used for devices or functional elements here in FIG. 21 as those used for the second and third example of the tool magazine shown in FIG. 6 and FIG. 13. Each gondola carries three pairs of tool assemblies as shown in FIG. 24. The right-hand side is a manually tool changing location 30 in FIG. 21 at which a table 44 is attached to the magazine 27.

In FIG. 22–24, the structure of the table 44 is explained. The table 44 includes a box-shaped main body 166 which is movable to the right and the left in FIG. 23 or in the direction Y as described above. Next to the main body 166, a worktable 168 is installed as shown in FIG. 24. An operator moves tool assemblies manually to and fro between the main body 166 and the worktable 168 for replacement of tool assemblies 6 in the gondola 31 with other tool assemblies. Three pairs of guide rails 170 extending in the direction X are mounted on the main body 166. Upper or lower die holders 8 or 10 are placed on the guide rails 170.

An upright plate 172 is slidably mounted on the tool magazine 27, and to the upright plate 172 a horizontal plate 176 is fixed as shown in FIGS. 22 and 23. A plurality of small vertical plates 178, 180 spaced in the direction Y are provided in order to connect the upright and horizontal plates 172 and 176 rigidly and to reinforce the horizontal plate 176.

The horizontal plate 176 is provided with, for example, four bearing blocks 182, 184, 186, and 188. Two of the bearing blocks 182 and 186 are connected to each other by a shaft 190, while the other two bearing blocks 184 and 188 are connected to each other by a shaft 192. The shaft 190 is connected at a front end through the bearing block 182 to a lower end of a link 194 and at a rear end through the bearing block 186 to a lower end of a link 198 and to an upper end of a link 202. The shaft 192 is connected at a front end through the bearing block 184 to a lower end of a link 196 and at a rear end through the bearing block 188 to a lower end of a link 200 and to an upper end of a link 204. Lower ends of the links 202 and 204 are connected to both ends of a horizontal link 210 with hinges 206 and 208 respectively.

A pneumatic or hydraulic cylinder 214 is supported at its lower end on the upright plate 172 rotatably around a pin 212. An upper end 218 of a piston rod 216 of the cylinder 214 is attached to the horizontal link 210 as shown in FIG. 23.

A plate 220 is attached to the bottom of the main body 166 for supporting four blocks 224. Each of the blocks 224 is provided with a groove 222 extending transversely (or in the direction Y). Four guide rollers 226 are rotatably attached to upper ends of the links 194, 196, 198, and 200 and are placed in the grooves 222 of the blocks 224. The plate 220 is provided with a plurality of vertical guide rods 228 which extend downwards and penetrate the horizontal plate 176.

The table 44 is designed as mentioned above, so that the links 202, 204 are rotated clockwise through the horizontal link 210 when the piston rod 216 of the cylinder 214 is extended up to a place shown by imaginary lines in FIG. 23. As a result, the links 194, 196, 198, and 200 are also rotated clockwise simultaneously, while guide rollers 226 are rolled in the grooves 222 towards the right. Hence, the table 44 is lowered in position. In this lower position of the table 44, the lower die holders 10 are moved horizontally along the guide rails 170. The table 44 is raised up in position when the piston rod 216 is plunged in the cylinder 214. In this upper position of the table 44, the upper die holders 8 are moved horizontally along the guide rails 170. When the table 44 is moved to and fro between the upper and lower positions, it is guided vertically by the guide rods 228.

Accordingly, the upper and lower die holder 8 and 10 are placed in the upper and lower positions respectively not manually but automatically. Furthermore, the operator can draw or push the upper and lower die holders 8 and 10 one by one in any order. In addition, the table 44 does not falls in even if the pressure of the fluid in the cylinder 214 drops suddenly, since the upper and lower die holders are located at the two heights by means of the link mechanism.

Furthermore, the operator can use both hands for handling the upper and lower die holders if he uses a foot switch 230 (FIG. 25) connected to a pump motor (not shown) of the cylinder 214 for actuating the cylinder 214. As shown in FIG. 5 the tool assemblies are carried to and fro between the table 44 and a wagon 238 by means of an air cylinder balancer 234 which is suspended from the tool magazine 27 by a fold-away suspender 232 and which has at a lower end a L-shaped tool for engaging with the tool assemblies 8, 10. The air cylinder 234 is movable in the direction X along the suspender 232, as well as in the direction Z.

We claim:

1. A tool magazine for a punch press comprising:

a frame;

a plurality of tool mounting gondolas, means for movably vertically mounting said plurality of tool mounting gondolas on said frame, each tool mounting gondola having an upper portion and a lower portion;

said upper portion being adapted to support an upper die holder for supporting a punch, said upper die holder being removable in a horizontal direction from said upper portion, and said punch being removable from said upper die holder in a vertical direction;

said lower portion being adapted to support a lower die holder for supporting a die, said lower die holder being removable in a horizontal direction from said lower portion, and said die being removable from said lower die holder in a vertical direction;

a table provided at a predetermined location of said magazine, each of said plurality of tool mounting gondolas being selectively positioned at a location adjacent to said predetermined location;

an upper horizontal guide and a lower horizontal guide being provided respectively on upper and lower parts of said table, said upper and lower die holders being drawn out of said gondola, being received, respectively, by said upper and lower horizontal guides, and being slidable, respectively, along said upper and lower horizontal guides.

2. The tool magazine of claim 1, wherein each of said plurality of tool mounting gondolas includes a plurality of said upper and lower die holders arranged horizontally, and said table of said tool magazine being slidable horizontally to stop in front of each pair of said upper and lower die holders when said gondola is positioned at said predetermined location.

3. The tool magazine of claim 1, wherein said table of said tool magazine includes at least two guides arranged at two different heights, whereby said upper and lower die holders are drawn out horizontally, respectively, along said at least two guides and placed in a position on said table.

4. The tool magazine of claim 3, wherein said upper and lower die holders are drawn out horizontally in parallel directions and placed in said positions on said table, said positions being vertically offset.

5. The tool magazine of claim 1, wherein said table comprises means to fold said table to an inoperative position.

6. The tool magazine of claim 1, wherein said table includes at least a device for sliding along at least one of said upper and lower horizontal guides of said table and engaging at least one of said upper and lower die holders for horizontally drawing out and pushing said at least one of said upper and lower die holders.

* * * * *

UNITED STATES PATENT AND TRADEMARK OFFICE

CERTIFICATE OF CORRECTION

PATENT NO. : 5,320,595

DATED : June 14, 1994

INVENTOR(S) : Tadashi HIRATA et al.

It is certified that error appears in the above-indentified patent and that said Letters Patent is hereby corrected as shown below:

On the cover of the printed patent, section [75] Inventors, line 2, change "Kanagawa" to ---Kanagawa-ken---.

On the cover of the printed patent, section [56] U.S. Patent Documents, line 6, change "Sahari" to ---Sahashi---.

At column 1, line 56 of the printed patent, insert ---and moved for changing without overturn.--- after "stored".

At column 1, line 67 of the printed patent, change "carrying" to ---carrying section---.

At column 2, line 67 of the printed patent, change "fold" to ---folded---.

At column 3, line 58 of the printed patent, change "consisted" to ---consisting---.

At column 3, line 61 of the printed patent, change "consisted" to ---consisting---.

At column 4, line 43 of the printed patent, change "is disposed" to ---there disposed is---.

At column 5, line 6 of the printed patent, change "FIG. 3-5," to ---FIGS. 3-5,---.

At column 5, line 22 of the printed patent, change "are" to ---is---.

At column 5, line 36 of the printed patent, delete "there".

At column 5, line 46 of the printed patent, delete "there".

At column 6, line 22 of the printed patent, change "mounded" to ---mounted---.

At column 6, line 35 of the printed patent, change "may" to ---may be---.

UNITED STATES PATENT AND TRADEMARK OFFICE

CERTIFICATE OF CORRECTION

PATENT NO. : 5,320,595

DATED : June 14, 1994

INVENTOR(S) : Tadashi HIRATA et al.

It is certified that error appears in the above-indentified patent and that said Letters Patent is hereby corrected as shown below:

At column 6, line 45 of the printed patent, insert ---,--- after "for example".

At column 8, line 53 of the printed patent, change "FIG." to ---FIGS.---.

At column 8, line 64 of the printed patent, change "FIG." to ---FIGS.---.

At column 9, line 65 of the printed patent, change "falls" to ---fall---.

At column 10, line 9 of the printed patent, change "a L-shaped" to ---an L-shaped---.

Signed and Sealed this

Twenty-sixth Day of September, 1995

*Attest:*

Bruce Lehman

BRUCE LEHMAN

*Attesting Officer*

*Commissioner of Patents and Trademarks*